US008111211B2

(12) United States Patent
Lee

(10) Patent No.: US 8,111,211 B2
(45) Date of Patent: Feb. 7, 2012

(54) PLASMA DISPLAY COMPRISING AT LEAST FIRST AND SECOND GROUPS OF ELECTRODES AND DRIVING METHOD THEREOF

(75) Inventor: Joo-Yul Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1026 days.

(21) Appl. No.: 12/023,927

(22) Filed: Jan. 31, 2008

(65) Prior Publication Data

US 2008/0238822 A1 Oct. 2, 2008

(30) Foreign Application Priority Data

Mar. 26, 2007 (KR) ..... 10-2007-0029330

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS

| | | | | |
|---|---|---|---|---|
| 6,362,800 | B1 * | 3/2002 | Moon | 345/60 |
| 6,710,755 | B1 * | 3/2004 | Shiozaki et al. | 345/60 |
| 7,339,556 | B2 | 3/2008 | Kim et al. | |
| 2002/0018031 | A1 * | 2/2002 | Nakamura et al. | 345/60 |
| 2004/0160392 | A1 | 8/2004 | Kim et al. | |
| 2004/0212566 | A1 * | 10/2004 | Marcotte | 345/60 |
| 2005/0035935 | A1 | 2/2005 | Kang et al. | |
| 2005/0219157 | A1 | 10/2005 | Lee | |
| 2006/0038806 | A1 | 2/2006 | Jeong | |
| 2006/0119544 | A1 * | 6/2006 | Setoguchi et al. | 345/60 |

FOREIGN PATENT DOCUMENTS

| | | |
|---|---|---|
| EP | 1 172 787 A1 | 1/2002 |
| EP | 1 424 677 A2 | 6/2004 |
| EP | 1 763 011 A2 | 3/2007 |
| JP | 7-191627 | 7/1995 |
| JP | 2005-215670 | 8/2005 |
| JP | 2005-284249 | 10/2005 |
| JP | 2006-058884 | 3/2006 |
| KR | 2002-0027144 | 4/2002 |
| KR | 2002-0096828 | 12/2002 |
| KR | 10-2004-0046264 | 6/2004 |
| KR | 10-2005-0078470 | 8/2005 |

(Continued)

OTHER PUBLICATIONS

Korean Patent Abstracts, Publication No. 1020020027144 A; Date of Publication: Apr. 13, 2002; in the name of Hitoshi Hirakawa et al.

(Continued)

*Primary Examiner* — Richard Hjerpe
*Assistant Examiner* — Andrew Schnirel
(74) *Attorney, Agent, or Firm* — Christie, Parker & Hale, LLP

(57) ABSTRACT

A plasma display includes a plurality of first electrodes divided into at least two groups. In the plasma display, first group cells corresponding to first electrodes of the first group are initialized, and light emitting cells are selected from the first group cells to be sustain-discharged. In addition, second group cells corresponding to the first electrodes of the second group are initialized, and light emitting cells are selected from the second group cells to be sustain-discharged.

18 Claims, 14 Drawing Sheets

FOREIGN PATENT DOCUMENTS

| | | |
|---|---|---|
| KR | 10-2006-0016568 | 2/2006 |
| KR | 10-0573163 | 4/2006 |
| KR | 10-2006-0053345 | 5/2006 |
| KR | 10-2007-0090545 | 9/2007 |

OTHER PUBLICATIONS

Korean Patent Abstracts, Publication No. 1020050078470 A; Date of Publication: Aug. 5, 2005; in the name of Jin Sung Kim et al.

Korean Patent Abstracts, Publication No. 1020060016568 A; Date of Publication: Feb. 22, 2006; in the name of Jae Seok Jeong.

Korean Patent Abstracts, Publication No. 100573163 B1; Date of Publication: Apr. 17, 2006; in the name of Tae Kyoung Kang.

European Search Report dated May 11, 2010, for corresponding European Patent application 08250580.1, noting listed references in this IDS.

Patent abstracts of Japan for publication No. 07-191627 dated Jul. 28, 1995 in the name of Shiyuuji Nakamura, et al.

Korean patent abstracts for publication No. 1020020096828 dated Dec. 31, 2002 in the name of Hitoshi Hirakawa, et al.

Korean patent abstracts for publication No. 1020040046264 dated Jun. 5, 2004 in the name of Seung Hun Chae, et al.

Korean patent abstracts for publication No. 1020060053345 dated May 22, 2006 in the name of Kazuhito Ito.

Korean patent abstracts for publication No. 1020070090545 dated Sep. 6, 2007 in the name of Joo Yul Lee.

Extended European Search Report dated Sep. 10, 2010 in corresponding European application No. 08250580.1, listing the cited references in this IDS as well as the references in an IDS filed on Jul. 14, 2010.

JIPO Office action (in Japanese) dated Nov. 9, 2010, for corresponding Japanese patent application No. JP 2007-275518, listing the cited references in this IDS, as well as the references cited in the IDSs filed on Jul. 14, 2010 and Oct. 29, 2010.

EPO Office Action dated Sep. 29, 2011, for corresponding European Patent Application No. 08 250 580.1, 5 pages.

* cited by examiner

PLASMA DISPLAY COMPRISING AT LEAST FIRST AND SECOND GROUPS OF ELECTRODES AND DRIVING METHOD THEREOF

CROSS-REFERENCE TO RELATED APPLICATION

This application claims priority to and the benefit of Korean Patent Application No. 10-2007-0029330 filed in the Korean Intellectual Property Office on Mar. 26, 2007, the entire content of which is incorporated herein by reference.

BACKGROUND OF THE INVENTION (a) Field of the Invention

The present invention relates to a plasma display and a driving method thereof.

(b) Description of the Related Art

A plasma display panel (PDP) is a flat panel display that uses plasma generated by gas discharge to display characters or images. It includes, depending on its size, more than hundreds of thousands to millions of pixels arranged in a matrix pattern.

One frame of such a plasma display is divided into a plurality of subfields having weight values, and each subfield includes a reset period, an address period, and a sustain period. The reset period is for initializing the status of each discharge cell so as to facilitate an addressing operation on the discharge cell. The address period is for selecting turn-on/turn-off cells (i.e., cells to be turned on or off). In addition, the sustain period is for causing the cells to sustain discharge for displaying an image on the addressed.

In general, a wall charge state after the reset period is set such that address discharge is performed stably. Furthermore, in the address period, a scan pulse is sequentially applied to all scan electrodes and an address voltage is applied to address electrodes corresponding to light emitting cells, so that light emitting cells are selected. However, in the case of cells corresponding to the scan electrodes to which the scan pulse is applied late in time, it is possible for a wall charge state after the reset period to be lost. In other words, a wall charge state set in the reset period is lost as time passes. In the case of discharge cells that are selected late in time, the loss of wall charges becomes profound. Thus, a low address discharge may occur in cells that are selected late in time due to the loss of wall charges. The loss of wall charges becomes even more profound when the temperature is high or there are many priming particles.

The above information disclosed in this Background section is only for enhancement of understanding of the background of the invention and therefore it may contain information that does not form the prior art that is already known in this country to a person of ordinary skill in the art.

SUMMARY OF THE INVENTION

In exemplary embodiments according to the present invention, a plasma display for stably performing an address discharge, and a driving method thereof, is provided.

In an exemplary embodiment according to the present invention, a method for driving a plasma display is provided. The plasma display includes a plurality of first electrodes having at least a first group and a second group, a plurality of second electrodes crossing the plurality of first electrodes, and a plurality of cells including first group cells and second group cells. The method includes: initializing the first group cells corresponding to the first electrodes of the first group during a first period; selecting first group light emitting cells from the first group cells during a second period; during a third period, sustain-discharging the first group light emitting cells selected during the second period; initializing the second group cells corresponding to the first electrodes of the second group during a fourth period; selecting second group light emitting cells from the second group cells during a fifth period; and during a sixth period, sustain-discharging the second group light emitting cells selected during the fifth period. Here, the first group cells may not be initialized during the fourth period, and the first group light emitting cells may be sustain-discharged during the sixth period.

In addition, in the driving method, the first group cells may be initialized during a seventh period, eighth period first group light emitting cells may be selected from the first group cells during an eighth period, the eighth period first group light emitting cells selected during the eighth period may be sustain discharged during a ninth period, the second group cells may not be initialized during the seventh period, and the second group light emitting cells may be sustain-discharged during the ninth period. Here, a number of sustain-discharges generated during the third period may be the same as a number of the sustain-discharges generated during the ninth period. The plasma display may further include a plurality of third electrodes extending in the same direction as the plurality of first electrodes, a last sustain-discharge may be generated in the second group light emitting cells since a first voltage and a second voltage which is lower than the first voltage may be respectively applied to the first electrodes of the first group and the first electrodes of the second group while a third voltage is applied to the plurality of third electrodes during the sixth period, a voltage at the first electrodes of first and second groups may be gradually decreased to a fourth voltage that is lower than the third voltage during the seventh period, the first voltage and the second voltage may be lower than the third voltage.

In addition, the first, second, and third periods may correspond to a first subfield of the first group, the fourth, fifth, and sixth periods may correspond to a first subfield of the second group, and the first subfields of the first and second groups respectively may have the lowest weight values. Further, the first group light emitting cells may be sustain-discharged during the third period, and the second group light emitting cells may be sustain-discharged during the sixth period.

The first, second, and third periods may correspond to the first subfield of the first group, and the fourth, fifth, and sixth periods may correspond to the first subfield of the second group. In a second subfield having a weight value that is lower than that of the first subfields of the first and second groups, discharge cells corresponding to the plurality of first electrodes may be initialized, and the discharge cells may be sustain-discharged after the light emitting cells are selected from the discharge cells.

In another exemplary embodiment according to the present invention, a method for driving a plasma display including a plurality of first electrodes having a first group and a second group, a plurality of second electrodes crossing the plurality of first electrodes and a plurality of cells including first group cells and second group cells, is provided. The method includes: initializing the first group cells corresponding to the plurality of first electrodes during a first period of a first subfield; sustain-discharging first group light emitting cells after selecting the first group light emitting cells from the first group cells during a second period of the first subfield; initializing the first group cells during a first period of a second subfield; selecting second subfield first group light emitting cells from the first group cells during a second period of the second subfield; during a third period of the second subfield, sustain-discharging the second subfield first group light emitting cells selected during the second period of the second subfield; selecting second group light emitting cells from the second group cells corresponding to first electrodes of the second group among the plurality of first electrodes during a fourth period of the second subfield; and during a fifth period of the second subfield, sustain-discharging the second group light emitting cells selected during the fourth period of the second subfield. Here, the second group cells may be initialized during the first period of the second subfield. In addition, the second group cells may be initialized during a sixth period of the second subfield, and the sixth period of the second subfield may be a period between the third period of the second subfield and a fourth period of the second subfield.

In another exemplary embodiment according to the present invention, a plasma display including a plasma display panel and a driver is provided. The plasma display panel includes a plurality of first electrodes extending in a first direction and a plurality of second electrodes extending in a second direction crossing the first direction, the plurality of first electrodes including a plurality of groups having a first group and a second group, and a plurality of cells for displaying an image, the plurality of cells including first group cells and second group cells; and a driver for driving the plasma display panel, such that one frame is divided into a plurality of subfields. The driver is adapted to initialize the first group cells corresponding to the first electrodes of the first group during a first period of a first subfield, to select first group light emitting cells from the first group cells during a second period of the first subfield, to sustain-discharge the first group light emitting cells selected during the first period of the first subfield during a third period of the first subfield, to initialize the second group cells corresponding to the first electrodes of the second group during a fourth period of the first subfield, to select second group light emitting cells from the second group cells during a fifth period of the first subfield, and to sustain-discharge the second group light emitting cells selected during the fifth period of the first subfield during a sixth period of the first subfield.

Further, the driver may apply a first waveform gradually increasing from a first voltage to a second voltage and gradually decreasing to a third voltage to the first electrodes of the second group and apply a second waveform gradually increasing to a fourth voltage and gradually decreasing to a fifth voltage to the first electrodes of the first group during the fourth period of the first subfield, the second voltage being higher than the fourth voltage, and the first group cells may not be initialized during the fourth period of the first subfield. The first group light emitting cells may be sustain-discharged during the sixth period of the first subfield. The driver may apply a scan pulse of a sixth voltage to first electrodes to be selected among the first electrodes of the second group and may apply a seventh voltage that is higher than the sixth voltage to first electrodes that are not selected among the first electrodes of the first group during the fifth period of the first subfield, and a difference between the seventh voltage and the sixth voltage may be substantially the same as the first voltage. The driver ma apply a third waveform gradually increasing from a sixth voltage to a seventh voltage and gradually decreasing to an eighth voltage to the first electrodes of the first group and apply a fourth waveform gradually increasing to a ninth voltage and gradually decreasing to a tenth voltage to the first electrodes of the second group during the first period of the first subfield, the seventh voltage may be higher than the ninth voltage, and the second group cells may not be initialized during the first period of the first subfield.

Here, the first subfield may have the lowest weight value, the driver may gradually increase voltages at the first electrodes of the first and second groups from a first voltage to a second voltage and may gradually decrease the voltages to a third voltage during the first period of the first subfield, and the second group cells may be initialized during the first period of the first subfield. The driver may gradually increase the voltages at the first electrodes of the first and second groups from the first voltage to a fourth voltage and may gradually decrease the voltage to the third voltage during the fourth period of the first subfield, the fourth voltage may be lower than the second voltage, and the first group cells may be initialized during the fourth period of the first subfield.

The plasma display panel may further include a plurality of third electrodes extending in the same direction as the first direction. The driver may generate a last sustain-discharge in the first group light emitting cells by respectively applying a first voltage and a second voltage to the first electrodes of the first group and the first electrodes of the second group while applying a third voltage to the plurality of third electrodes during the third period of the first subfield, and may gradually decrease voltages at the first electrodes of the first and second groups to a fourth voltage that is lower than the first voltage during the fourth period of the first subfield. The first voltage and the second voltage may be lower than the third voltage.

In another exemplary embodiment according to the present invention, a plasma display includes a plasma display panel (PDP) and a driver. The PDP includes a plurality of scan electrodes including a plurality of groups having a first group and a second group. The driver includes a first group selection circuit and a second group selection circuit that are respectively coupled to the scan electrodes of the first group and the scan electrode of the second group, and drives the PDP. The first group selection circuit and the second group selection circuit respectively include a first transistor and a second transistor each having a node that is coupled to the respective plurality of scan electrodes. The driver further includes a capacitor having a first terminal coupled to the first transistor of the first group selection circuit and the first transistor of the second group selection circuit and a second terminal coupled to the first transistor of the first group selection circuit and the second transistor of the second group selection circuit and is charged with a first voltage corresponding to a difference between a scan voltage and a non-scan voltage that are applied to the scan electrodes during an address period, and a third transistor coupled between a first power source for supplying the second voltage and the second terminal of the capacitor. The first reset waveform is applied to the scan electrodes of the first group through the first power source, the third transistor, the capacitor, and the first transistor of the first group selection circuit during a first reset period. The second reset waveform is applied to the scan electrodes of the second group through the first power source, the third transistor, and the second transistor of the second group selection circuit during the first reset period.

Here, a voltage at the scan electrodes of the first group may be gradually increased to a voltage corresponding to a sum of the first voltage and the second voltage, and a voltage at the scan electrodes of the second group may be gradually increased to the second voltage during the first reset period.

In addition, the driver may further include a fourth transistor coupled between a second power source for supplying a third voltage that is lower than the second voltage and the second terminal of the capacitor, a third reset waveform may be applied to the scan electrode of the first group through the second power source, the fourth transistor, the capacitor, and the first transistor of the first group selection circuit during a second reset period, and a fourth reset waveform may be applied to the scan electrode of the second group through the second power source, the fourth transistor, and the second transistor of the second group selection circuit during the second reset period. During the second reset period, a voltage at the scan electrode of the first group may be gradually increased to a voltage corresponding to a sum of the third voltage and the first voltage, and a voltage at the scan electrode of the second group may be gradually increased to the third voltage.

DETAILED DESCRIPTION OF THE EMBODIMENTS

Figure 1:
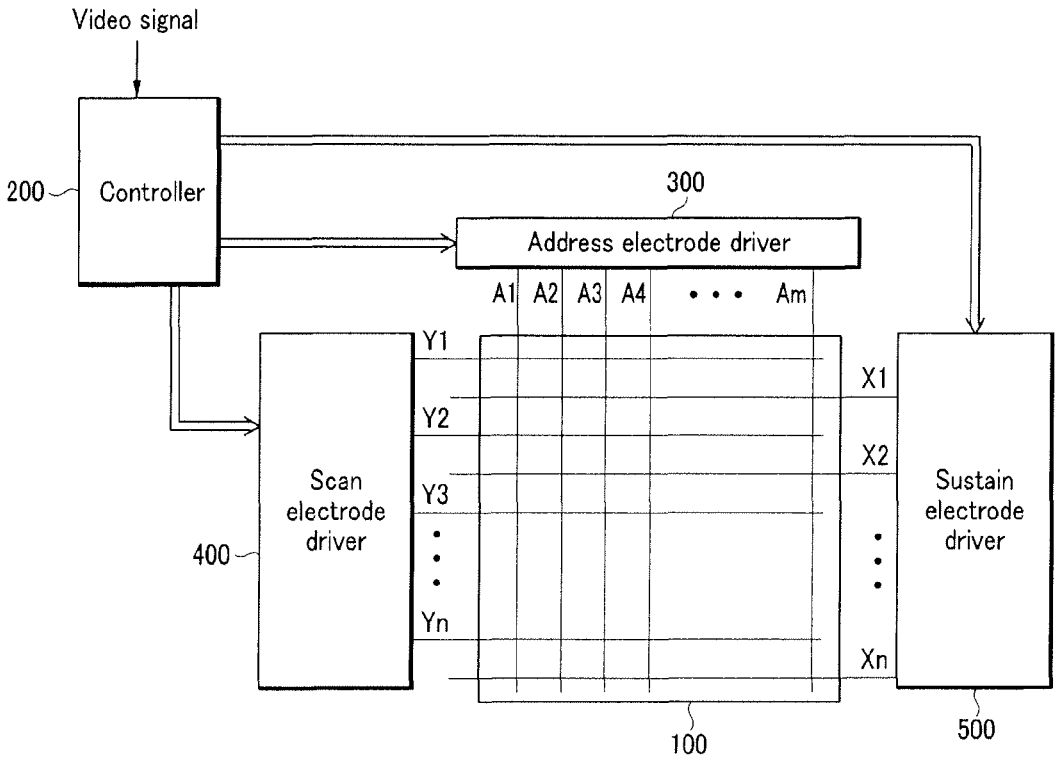
FIG. 1 is a schematic diagram of a configuration of a plasma display according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

In addition, wall charges mentioned in the following description mean charges formed and accumulated on a wall (e.g., a dielectric layer) close to an electrode of a discharge cell. Though wall charges do not actually come in contact with an electrode, the wall charges will be described as being "formed" or "accumulated" on the electrode. The term "wall voltage" refers to a potential difference formed on the wall of a discharge cell by wall charges.

When it is described in the specification that a voltage is maintained, it should not be understood to strictly imply that the voltage is maintained exactly at a predetermined voltage. To the contrary, even if a voltage difference between two points varies, the voltage difference is expressed to be maintained at a predetermined voltage in the case that the variance is within a range allowed in design constraints or in the case that the variance is caused due to a parasitic component that is usually disregarded by a person of ordinary skill in the art. Furthermore, a threshold voltage of semiconductor devices, such as transistors and diodes, is very much lower than a discharge voltage. Therefore, the threshold voltage is approximated herein, and considered to be 0V.

A plasma display according to exemplary embodiments of the present invention and a driving method thereof will now be described in detail with reference to the drawings.

FIG. 1 is a schematic diagram of a configuration of a plasma display according to an exemplary embodiment of the present invention.

As shown in FIG. 1, the plasma display according to the exemplary embodiment of the present invention includes a plasma display panel (PDP) 100, a controller 200, an address electrode driver 300, a scan electrode driver 400, and a sustain electrode driver 500.

The PDP 100 includes a plurality of address electrodes A1 to Am extending in a column direction, and a plurality of sustain and scan electrodes X1 to Xn and Y1 to Yn extending in a row direction in pairs. Generally, the sustain electrodes X1 to Xn are formed in correspondence to the respective scan electrodes Y1 to Yn, and the sustain electrodes X1 to Xn are coupled to each other at one end. In addition, the PDP 100 includes a substrate on which the sustain and scan electrodes X1 to Xn and Y1 to Yn are arranged (not shown), and another substrate on which the address electrodes A1 to Am are arranged (not shown). The two substrates are placed facing each other with discharge spaces therebetween so that the scan electrodes Y1 to Yn and the address electrodes A1 to Am may perpendicularly cross each other and the sustain electrodes X1 to Xn and the address electrodes A1 to Am may perpendicularly cross each other. Herein, each of the discharge spaces formed at respective crossing regions of the address electrodes A1 to Am and the sustain and scan electrodes X1 to Xn and Y1 to Yn forms a discharge cell. This is an exemplary structure of the PDP 100, and panels of other structures can be applied to embodiments of the present invention.

The controller 200 receives external video signals and outputs an address electrode driving control signal, a sustain electrode driving control signal, and a scan electrode driving control signal. In addition, the controller 200 divides one frame into a plurality of subfields and drives the subfields, and each subfield includes a reset period, an address period, and a sustain period with respect to time. Further, according to the exemplary embodiment of the present invention, to prevent the low address discharge, the Y electrodes Y1 to Yn are divided into at least two groups, and the reset period, the address period, and the sustain period are performed for the Y electrodes of each group.

The address electrode driver 300 receives the address electrode driving control signal from the controller 200 and applies a display data signal to each address electrode (A1 to Am) so as to select discharge cells to be displayed.

The scan electrode driver 400 receives the scan electrode driving control signal from the controller 200 and applies a driving voltage to Y electrodes (Y1 to Yn).

The sustain electrode driver 500 receives the sustain electrode driving control signal from the controller 200 and applies a driving voltage to X electrodes (X1 to Xn).

A driving method of the plasma display according to a first exemplary embodiment of the present invention will now be described with reference to FIG. 2 and FIG. 3.

Figure 2:
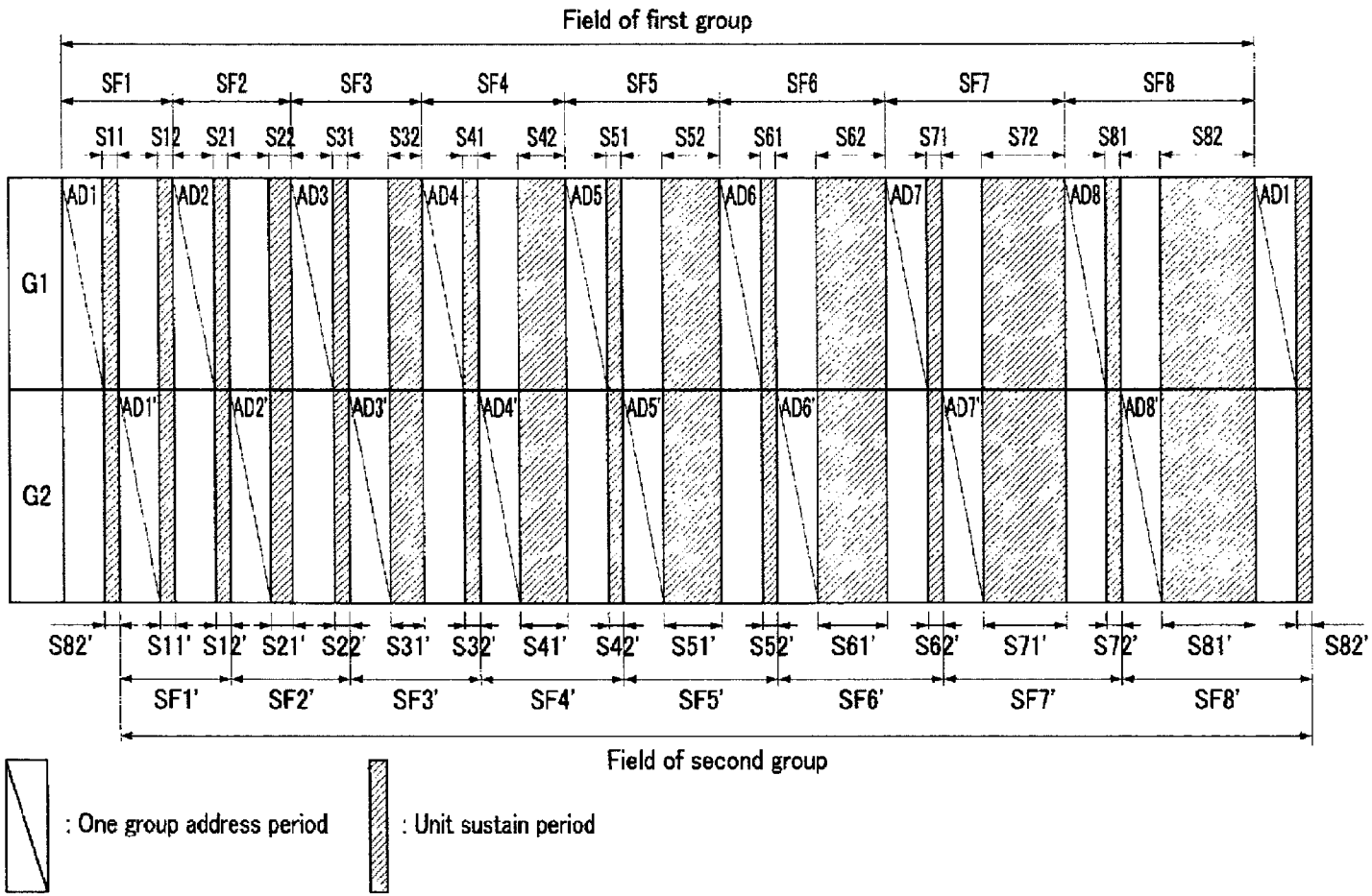
FIG. 2 is a diagram representing a subfield configuration of the plasma display according to a first exemplary embodiment of the present invention.
Figure 3:
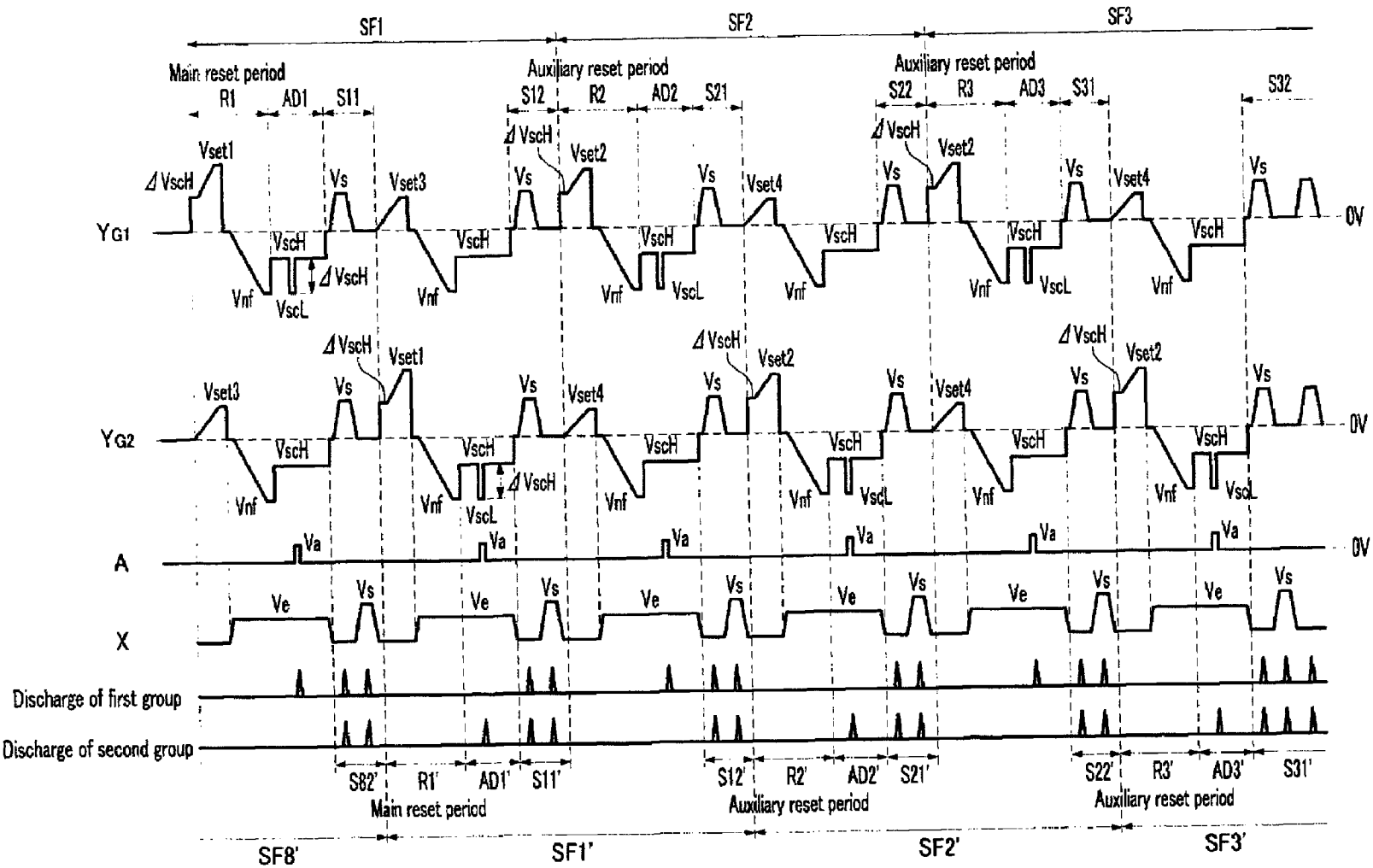
FIG. 3 is a diagram representing driving waveforms applied to the electrodes during the subfield configuration shown in FIG. 2.

FIG. 2 is a diagram representing a subfield configuration of the plasma display according to the first exemplary embodiment of the present invention, and FIG. 3 is a diagram representing driving waveforms applied to the subfield configuration shown in FIG. 2.

In FIG. 2 and FIG. 3, for the convenience of description, subfield configurations and driving waveforms applied to two groups $Y_{G1}$ and $Y_{G2}$ grouped from the plurality of Y electrodes Y1 to Yn are illustrated. That is, the plurality of Y electrodes Y1 to Yn may be grouped into at least two groups $Y_{G1}$ and $Y_{G2}$, the Y electrodes $Y_{G1}$ of a first group may be odd-numbered Y electrodes, and the Y electrodes $Y_{G2}$ of a second group may be even-numbered Y electrodes. In addition, in FIG. 2 and FIG. 3, G1 denotes cells formed with the Y electrodes $Y_{G1}$ of the first group and G2 denotes cells formed with the Y electrodes $Y_{G2}$ of the second group.

Referring to FIG. 2, one field is divided into a plurality of subfields SF1 to SF8 for the first group G1, and one field is divided into a plurality of subfields SF1' to SF8' for the second group G2. Each subfield includes a reset period (not shown in FIG. 2), an address period, and a sustain period, and has a weight value (e.g., a predetermined weight value) to express a gray level (or grayscale level). While the reset period is not illustrated in FIG. 2 for convenience, the reset period is provided prior to the address period of each group to initialize the corresponding group. After a light emitting cell is selected during the address period of each group, the sustain period for each group is provided. In addition, in FIG. 2, while it is illustrated that one field is divided into eight subfields for each group, one field may be divided into more or less than eight subfields.

Firstly, in a first subfield SF1 of the first group, an address period AD1 for selecting light emitting cells and non-light emitting cells among cells of the first group G1 is performed, and a sustain period S11 of the first group is performed. In this and other embodiments, the non-light emitting cells refer to those cells that are not selected for light emission in a subfield. In addition, an address period AD1' for selecting light emitting cells and non-light emitting cells among cells of the second group G2 is performed, and a sustain period S11' of the second group is performed. In the sustain period S11' of the second group, a sustain period S12 of the first group is performed. That is, since cells set as the light emitting cells in the address period AD1 of the first group are maintained as the light emitting cells in the sustain period S11' of the second group, the sustain period S12 is performed in the sustain period S11' of the second group. In addition, in the sustain period S11 of the first group, a part of a sustain period S82' of a last subfield of a previous field for the second group is performed.

Subsequently, in the second subfield SF2 of the first group, an address period AD2 for selecting light emitting cells and non-light emitting cells among the cells of the first group G1 is performed, and the sustain period S21 of the first group is performed. Here, in the sustain period S21 of the first group, a sustain period S12' of the second group is performed. In addition, an address period AD2' for selecting light emitting cells and non-light emitting cells from the cells of the second group G2 is performed, and a sustain period S21' of the second group is performed. In the sustain period S21' of the second group, a sustain period S22 of the first group is performed.

In a like manner as above, the sustain period is positioned immediately after the address period of each group for other subfields, and some sustain periods of the first group and some sustain periods of the second group are concurrently performed. In the subfield configuration according to the exemplary embodiment of the present invention, an interval from after the reset period to an end of the address period of the corresponding group may be reduced by half compared to the prior art in which the address period is performed for all discharge cells and the sustain period is performed. When the electrodes are grouped into n groups, the interval from after the reset period to an end of the address period of the corresponding group may be reduced by 1/n.

In addition, time differences (e.g., predetermined time differences) are provided to the subfields having the same weight in the first group G1 and the second group G2. For example, while the second subfield SF2 of the first group is performed, a part of a first subfield SF1' of the second group is performed. Since there is a time difference (e.g., a predetermined time difference) between the first group G1 and the second group G2, a time difference is caused between a field of the first group G1 and a field of the second group G2.

In addition, a unit sustain period is commonly provided to each subfield to match the sustain periods (i.e., the number of sustain-discharges) of subfields having the same weight value for each group. That is, as shown in FIG. 2, the sustain periods S11, S21, S31, . . . , and S81 that are firstly generated in each subfield of the first group are the unit sustain periods having the same length, and the sustain periods S12', S22', S32', . . . , and S82' that are secondly generated in each subfield of the second group are also the unit sustain periods.

The driving waveforms applied to the subfield configuration shown in FIG. 2 will be described with reference to FIG. 3.

In FIG. 3, for convenience of description, only some subfields among the plurality of subfields for each group are illustrated. That is, only the first to third subfields SF1 to SF3 of the first group G1 and the first to third subfields SF1' to SF3' of the second group G2 are shown. In addition, in FIG. 3, driving waveforms applied to one A electrode, one X electrode, and Y electrodes YG1 and YG2 of the first and second groups are illustrated.

As shown in FIG. 3, the reset period for generating a reset discharge is positioned before the address period of each group. In FIG. 3, a reset period R1 of the first subfield of the first group is illustrated as a main reset period, and remaining reset periods R2 and R3 of the first group are illustrated as auxiliary reset periods. In addition, a reset period R1' of the first subfield of the second group is illustrated as the main reset period, and remaining reset periods R2' and R3' of the second group are illustrated as the auxiliary reset periods. Here, the main reset period is a reset period for generating the reset discharge in all cells of the corresponding group, and the auxiliary reset period is the reset period for generating the reset discharge in light emitting cells in which the sustain-discharge has been generated in a previous subfield.

As shown in FIG. 3, in the main reset period R1 of the first subfield of the first group, while a reference voltage (0V in FIG. 3) is applied to the X and A electrodes, a voltage at the Y electrodes $Y_{G1}$ of the first group is gradually increased from a ΔVscH voltage to a Vset1 voltage. While it is illustrated that the voltage at the Y electrodes $Y_{G1}$ of the first group is increased in a ramp pattern in FIG. 3, another suitable gradually increasing voltage waveform may be applied. Since a weak discharge is generated between the Y electrodes $Y_{G1}$ of the first group and the X electrodes and between the Y electrodes $Y_{G1}$ of the first group and the A electrodes while the voltage at the Y electrodes $Y_{G1}$ of the first group is increased, (−) wall charges are formed on the Y electrodes $Y_{G1}$ of the first group, and (+) wall charges are formed on the X and A electrodes. In this case, the Vset1 voltage is set to be higher than a discharge firing voltage Vfxy between the X and Y electrodes so as to generate a discharge in all cells of the first group G1.

In addition, the voltage at the Y electrodes $Y_{G1}$ of the first group is increased from the ΔVscH voltage (VscH−VscL) in FIG. 3, so as to selectively apply a reset operation to two groups by one scan electrode driving circuit that will be described with reference to FIG. 9. Accordingly, another voltage rather than the ΔVscH voltage may be set in other embodiments.

Subsequently, while the reference voltage and a Ve voltage are respectively applied to the A electrodes and the X electrodes, the voltage at the Y electrodes $Y_{G1}$ of the first group is decreased from the reference voltage to a Vnf voltage. While the voltage at the Y electrodes $Y_{G1}$ of the first group is decreased, the weak discharge is generated between the Y electrodes $Y_{G1}$ of the first group and the X electrodes and between the Y electrodes $Y_{G1}$ of the first group and the A electrodes. Thereby, the (−) wall charges formed on the Y electrodes $Y_{G1}$ of the first group are substantially eliminated, and the (+) wall charges formed on the X and A electrodes are substantially eliminated. In general, to prevent the cells that are not selected in the address period from being misfired during the sustain period, the Ve voltage and the Vnf voltage are set such that a wall voltage between the Y and X electrodes is close to 0V. That is, a (Ve−Vnf) voltage is set close to the discharge firing voltage Vfxy between the Y electrodes and the X electrodes.

In addition, in the main reset period R1 of the first subfield of the first group, a voltage at the Y electrodes $Y_{G2}$ of the second group is increased from the reference voltage to a Vset3 voltage, and is decreased from the reference voltage to the Vnf voltage. Here, the Vset3 voltage is set such that the reset discharge is not generated in the cells of the second group. Thereby, the reset discharge is not generated in the cells of the second group, and a previous wall charge state is maintained. In addition, as shown in FIG. 9, the Vset3 may be set to be (Vset1−ΔVscH) to selectively apply the reset operation to two groups by one scan electrode driving circuit.

While the Ve voltage is applied to the X electrodes during the address period AD1 of the first subfield of the first group, a scan pulse having a VscL voltage and an address pulse having a Va voltage are respectively applied to the Y electrodes $Y_{G1}$ of the first group to select the light emitting cells among the cells of the first group G1. In addition, the Y electrodes that are not selected among the Y electrodes $Y_{G1}$ of the first group are biased at a VscH voltage that is higher than the VscL voltage, and the reference voltage is applied to the A electrodes of the non-light emitting cells. Further, the VscH voltage is applied to the Y electrodes $Y_{G2}$ of the second group. Thereby, the light emitting cells in the first group G1 are selected in the address period AD1 of the first subfield of the first group. Here, the VscL voltage may be the same as or lower than the Vnf voltage.

Subsequently, in the sustain period S11 of the first subfield of the first group, a sustain pulse alternately having a high level voltage Vs and a low level voltage 0V is applied to the Y electrodes $Y_{G1}$ and $Y_{G2}$ of the first and second groups and the X electrodes. In this case, the sustain pulse applied to the Y electrodes $Y_{G1}$ and $Y_{G2}$ has an opposite phase to the sustain pulse applied to the X electrodes. Thereby, the sustain-discharge is generated in cells established as the light emitting cells in the address period AD1 of the first subfield of the first group. That is, the sustain-discharge is generated in the cells established as the light emitting cells among the cells of the first group G1. In FIG. 3, it is illustrated that the sustain pulse is applied twice, but it is not limited thereto, and the number of sustain pulses may vary in the unit sustain period. In this and other embodiments, the term "sustain pulse" may refer to one or more sustain pulses applied to the X and Y electrodes in accordance with the respective grayscale weight of the corresponding subfield.

In the sustain period S11 of the first subfield of the first group, the sustain-discharge may be generated in cells (i.e., cells in which the sustain discharge is generated in an eighth subfield SF8' of a previous field of the second group) established as the light emitting cells in a last subfield of a previous field among the cells of the second group G2.

Subsequently, in the main reset period R1' of the first subfield of the second group, while the reference voltage is applied to the X and A electrodes, the voltage at the Y electrodes $Y_{G2}$ of the second group is gradually increased from the ΔVscH voltage to the Vset1 voltage. In addition, while the reference voltage and the Ve voltage are respectively applied to the A electrodes and the X electrodes, the voltage at the Y electrodes $Y_{G2}$ of the second group is decreased from the reference voltage to the Vnf voltage. Since the Vset1 voltage may discharge all cells, the reset discharge is generated in all cells in the second group G2.

In the main reset period R1' of the first subfield of the second group, the voltage at the Y electrodes $Y_{G1}$ of the first group is increased to the Vset3 voltage, and is decreased to the Vnf voltage. Here, since the Vset3 voltage has a level that may not generate the reset discharge, the reset discharge is not generated in the cells of the first group G1. Accordingly, the selected cells of the first group G1 are maintained at the light emitting cell state that is a previous state.

In the address period AD1' of the first subfield of the second group, while the Ve voltage is applied to the X electrodes, the scan pulse having the VscL voltage and the address voltage having the Va voltage are respectively applied to the Y electrodes $Y_{G2}$ of the second group and the A electrodes to select light emitting cells among the cells of the second group G2. In addition, the Y electrodes that are not selected among the Y electrodes $Y_{G2}$ of the second group are biased at the VscH voltage that is higher than the VscL voltage, and the reference voltage is applied to the A electrodes of the non-light emitting cells. Further, the VscH voltage is applied to the Y electrodes $Y_{G1}$ of the first group. Thereby, in the address period AD1' of the first subfield of the second group, the light emitting cells are selected from the cells of the second group G2.

In the sustain period S11' of the first subfield of the second group, the sustain pulse alternately having the high level voltage Vs and the low level voltage 0V is applied to the Y electrodes $Y_{G1}$ and $Y_{G2}$ of the first and second group and the X electrodes. The sustain pulse applied to the Y electrodes $Y_{G1}$ and $Y_{G2}$ has an opposite phase to the sustain pulse applied to the X electrodes. Thereby, the sustain-discharge is generated in the cells established as the light emitting cells in the address period AD1' of the first subfield of the second group. That is, the sustain-discharge is generated in the cells established as the light emitting cells among the cells of the second group G2. In addition, since the cells of the first group G1 are not reset in the main reset period R1' of the first subfield of the second group, the sustain-discharge is generated in the cells previously established as the light emitting cells in the address period AD1 among the cells of the first group G1. That is, in the sustain period S11' of the first subfield of the second group, an operation of a sustain period S12 of the first subfield of the first group is performed.

In an auxiliary reset period R2 of the second subfield of the first group, while the reference voltage is applied to the X and A electrodes, the voltage at the Y electrodes $Y_{G1}$ of the first group is gradually increased from the ΔVscH voltage to the Vset2 voltage. In addition, while the reference voltage and the Ve voltage are respectively applied to the A electrodes and the X electrodes, the voltage at the Y electrodes $Y_{G1}$ of the first group is decreased from the reference voltage to the Vnf voltage. The Vset2 voltage is set to discharge only the cells in which the sustain-discharge was generated in a previous subfield. Accordingly, the reset discharge is generated in the cells in which the sustain-discharge was generated in a previous subfield SF1 of the cells of the first group G1. The cells that are not set as the light emitting cells and are not sustain-discharged in the previous subfield SF1 among the cells of the first group G1 are maintained at a wall charge state of the reset period R1 of the previous subfield. Accordingly, the cells of the first group G1 are initialized in the auxiliary reset period R2 of the second subfield of the first group G1.

In addition, the voltage at the Y electrodes $Y_{G2}$ of the second group is increased to a Vset4 voltage and is decreased to the Vnf voltage in the auxiliary reset period R2 of the second subfield of the first group. Here, since the Vset4 voltage has a level that may not generate the reset discharge, the reset discharge is not generated in the cells of the second group G2. Accordingly, the cells of the second group G2 are maintained at the light emitting cell state that is the previous state. The Vset4 voltage may be set to be a voltage of (Vset2−ΔVscH) to selectively apply the reset operation to two groups by one scan electrode driving circuit.

In the address period AD2 of the second subfield of the first group, while the Ve voltage is applied to the X electrodes, the scan pulse having the VscL voltage and the address pulse having the Va voltage are respectively applied to the Y electrodes $Y_{G2}$ of the first group and the A electrodes to select light emitting cells from the cells of the first group G1. In addition, the Y electrodes that are not selected among the Y electrodes $Y_{G1}$ of the first group are biased at the VscH voltage that is higher than the VscL voltage, and the reference voltage is applied to the A electrodes of the non-light emitting cells. Further, the VscH voltage is applied to the Y electrodes $Y_{G2}$ of the second group. Thereby, the light emitting cells are selected from the cells of the first group G1 in the address period AD2 of the second subfield of the first group.

Subsequently, the sustain pulse alternately having the high level voltage Vs and the low level voltage 0V is applied to the Y electrodes $Y_{G1}$ and $Y_{G2}$ of the first and second groups and the X electrodes in the sustain period S21 of the second subfield of the first group. In this case, the sustain pulse applied to the Y electrodes $Y_{G1}$ and $Y_{G2}$ and the sustain pulse applied to the X electrodes have opposite phases. Thereby, the sustain-discharge is generated in the cells established as the light emitting cells in the address period AD2 of the second subfield of the first group. That is, the sustain-discharge is generated in the cells established as the light emitting cells among the cells of the first group G1. In addition, since the cells of the second group G1 are not reset in the auxiliary reset period R2 of the second subfield of the first group, the sustain-discharge is generated in the cells established as the light emitting cells in the address period AD1' among the cells of the second group G2. That is, an operation of the sustain period S12' of the first subfield of the second group is performed in the sustain period S21 of the second subfield of the first group.

In an auxiliary reset period R2' of the second subfield of the second group, while the reference voltage is applied to the X and A electrodes, the voltage at the Y electrodes $Y_{G2}$ of the second group is gradually increased from the ΔVscH voltage to the Vset2 voltage. Subsequently, while the reference voltage and the Ve voltage are respectively applied to the A electrodes and the X electrodes, the voltage of the Y electrodes $Y_{G2}$ of the second group is decreased from the reference voltage to the Vnf voltage. Since the Vset2 voltage has a level that may discharge the cells in which the sustain-discharge was generated in the previous subfield, the reset discharge is generated in the cells that were sustain-discharged in a previous subfield SF1' among the cells of the second group G2. In addition, the cells that are not set as the light emitting cells among the cells of the second group G2 and were not sustain-discharged in the previous subfield SF1' are maintained at the wall charge state of the main reset period R1' of the previous subfield. Accordingly, the cells of the second group G2 are initialized in the auxiliary reset period R2' of the second subfield of the second group.

In a reset period R2' of the second subfield of the second group, the voltage at the Y electrodes $Y_{G1}$ of the first group is increased to the Vset4 voltage and is decreased to the Vnf voltage. Here, since the Vset4 voltage has a level that may not generate the reset discharge, the reset discharge is not generated in the cells of the first group G1. Accordingly, the cells of the first group G1 are maintained at the previous light emitting cell state.

In the address period AD2' of the second subfield of the second group, while the Ve voltage is applied to the X electrodes, the scan pulse having the VscL voltage and the address pulse having the Va voltage are respectively applied to the Y electrodes $Y_{G2}$ of the second group and the A electrodes to select light emitting cells from the cells of the second group G2. In addition, the Y electrodes that are not selected from the Y electrodes $Y_{G2}$ of the second group are biased at the VscH voltage that is higher than the VscL voltage, and the reference voltage is applied to the A electrodes of the non-light emitting cells. Further, the VscH voltage is applied to the Y electrodes $Y_{G1}$ of the first group. Thereby, the light emitting cells are selected from the cells of the second group G2 in the address period AD2' of the second subfield of the second group.

Subsequently, in the sustain period S21' of the second subfield of the second group, the sustain pulse alternately having the high level voltage Vs and the low level voltage 0V are applied to the Y electrodes $Y_{G1}$ and $Y_{G2}$ of the first and second groups and the X electrodes. The sustain pulse applied to the Y electrodes $Y_{G1}$ and $Y_{G2}$ and the sustain pulse applied to the X electrodes have opposite phases. Accordingly, the sustain-discharge is generated in the cells established as the light emitting cells in the address period AD2' of the second subfield of the second group. That is, the sustain-discharge is generated in the cells established as the light emitting cells among the cells of the second group G2. In addition, since the cells of the first group G1 are not reset in the auxiliary reset period R2' of the second subfield of the second group, the sustain-discharge is generated in the cells established as the light emitting cells among the cells of the first group G1. That is, an operation of the sustain period S22 of the second subfield of the first group is performed in the sustain period S21' of the second subfield of the second group.

Since driving waveforms applied to the third to eighth subfields are substantially the same as those of the first and second subfields except that the number of sustain-discharges corresponding to the weight value varies, detailed description thereof will be omitted.

In the first exemplary embodiment of the present invention, the number of sustain-discharges in the first subfield SF1 of the first group is determined by the number of sustain pulses applied to two unit sustain periods S11 and S12. In addition, the number of sustain-discharges applied to the first subfield SF1' of the second group is determined by the number of sustain pulses applied to two unit sustain periods S11' and S12'. As described, when the subfields SF1 and SF1' having the lowest weights respectively have two unit sustain periods, there is a limit to increasing the performance of expressing low gray levels. A method for reducing the number of sustain-discharges applied to the subfield having the lowest weight according to a second exemplary embodiment of the present invention will be described.

A driving method of the plasma display according to the second exemplary embodiment of the present invention will now be described with reference to FIG. 4 and FIG. 5.

Figure 4:
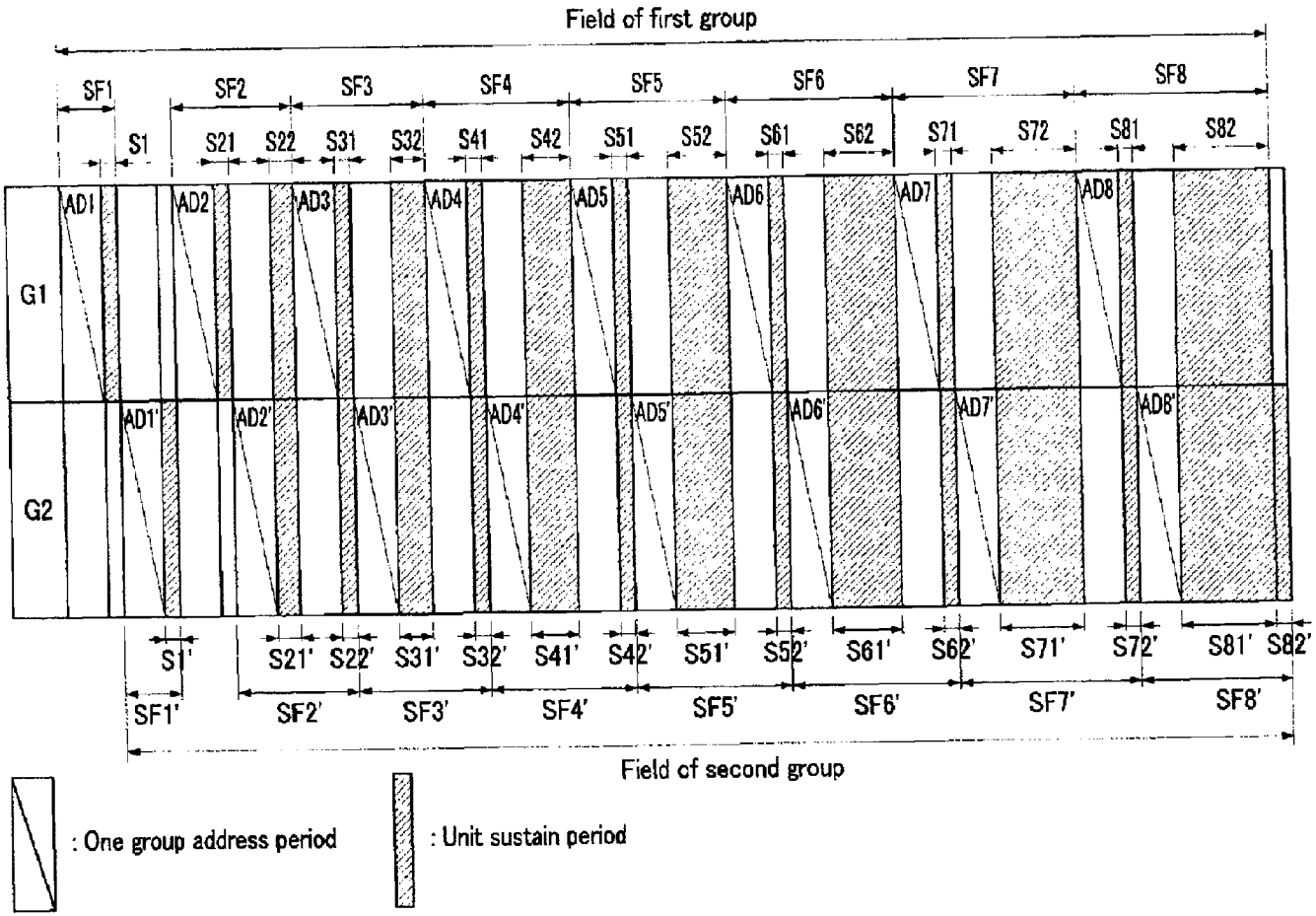
FIG. 4 is a diagram representing a subfield configuration of the plasma display according to a second exemplary embodiment of the present invention.
Figure 5:
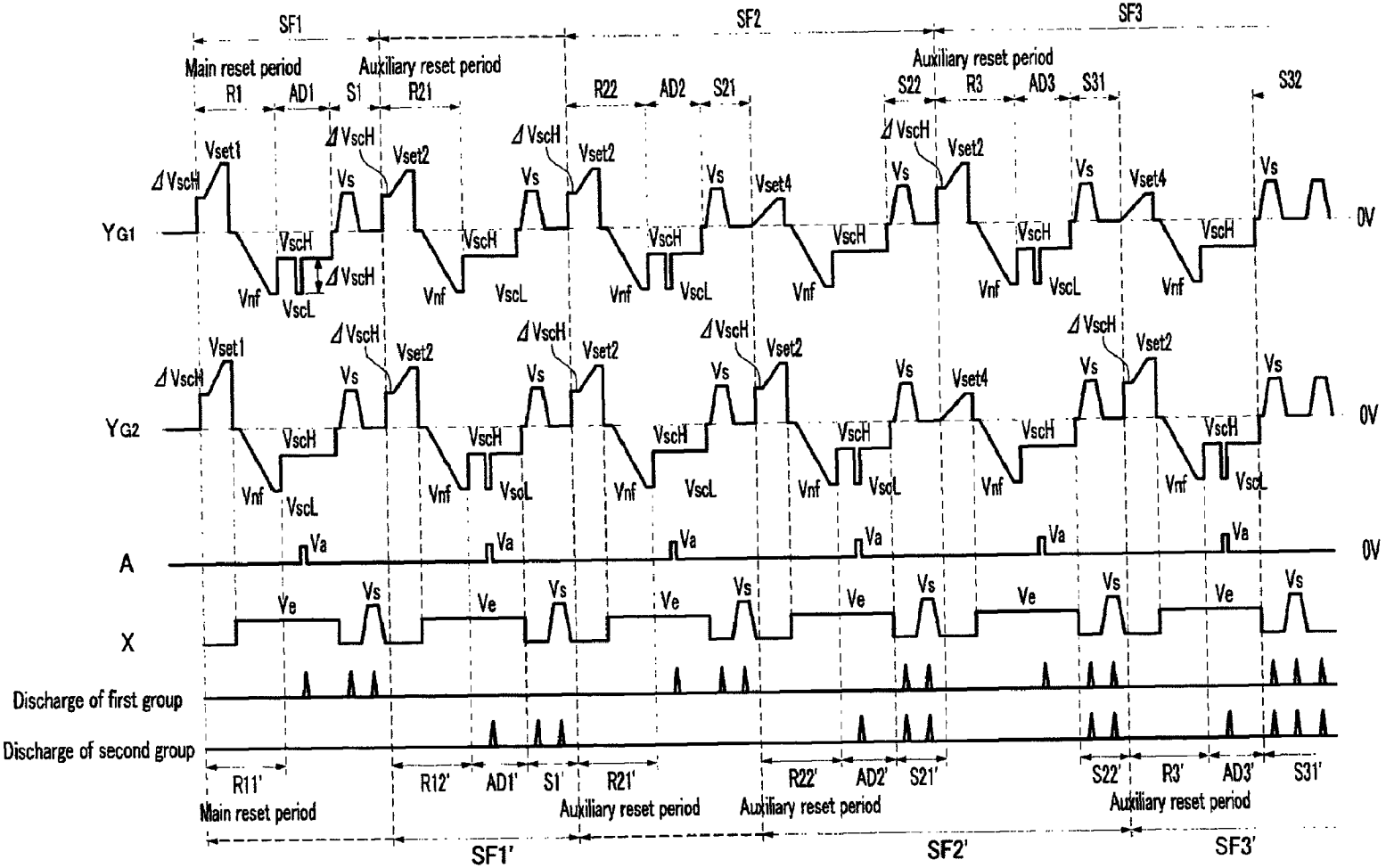
FIG. 5 is a diagram representing driving waveforms applied to the electrodes during the subfield configuration shown in FIG. 4.

FIG. 4 is a diagram representing the subfield configuration of the plasma display according to the second exemplary embodiment of the present invention, and FIG. 5 is a diagram representing driving waveforms applied to the subfield configuration shown in FIG. 4.

As shown in FIG. 4, since the subfield configuration according to the second exemplary embodiment of the present invention is substantially the same as that of the first exemplary embodiment of the present invention except for the first subfields SF1 and SF1' and the second subfields SF2 and SF2', the corresponding description already provided in reference to the first exemplary embodiment will not be repeated.

Firstly, in the first subfield SF1 of the first group, the address period AD1 for selecting light emitting cells and non-light emitting cells from the cells of the first group G1 is performed, and the sustain period S1 of the first group is performed. In the first subfield SF1' of the second group, the address period AD1' for selecting light emitting cells and non-light emitting cells from the cells of the second group G2 is performed, and a sustain period S1' of the second group is performed. Differing from the first exemplary embodiment of the present invention, the sustain periods of the first and second groups are not simultaneously (or concurrently) performed in the first subfields SF1 and SF1' according to the second exemplary embodiment of the present invention. Accordingly, since the first subfields SF1 and SF1' having minimum weight values respectively include one unit sustain period according to the second exemplary embodiment of the present invention, the performance of expressing low gray levels may be further increased.

In the second subfield SF2 of the first group, the address period AD2 for selecting light emitting cells and non-light emitting cells from the cells of the first group G1 is performed, and the sustain period S21 of the first group is performed. In the second subfield SF2' of the second group, the address period AD2' for selecting light emitting cells and non-light emitting cells from the cells of the second group G2 is performed, and the sustain period S21' of the second group is performed. Here, the sustain period S22 of the first group is performed in the sustain period S21' of the second group.

In remaining subfields, the sustain period is provided after the address period of each group in a like manner as the first exemplary embodiment of the present invention, a part of the sustain period of the first group and a part of the sustain period of the second group are concurrently performed. When each subfield is driven as above, a sustain period S82' corresponding to the unit sustain period is additionally provided in the eighth subfield of the second group as shown in FIG. 4. In the additional sustain period S82', the sustain period of the first group is not performed.

In a like manner as the first exemplary embodiment of the present invention, the interval from after the reset period to before the address period may be reduced using the subfield configuration according to the second exemplary embodiment of the present invention.

Driving waveforms applied to the subfield configuration shown in FIG. 4 will be described with reference to FIG. 5.

In FIG. 5, some of the plurality of subfields for each group are shown for convenience of description. That is, only the first to third subfields SF1 to SF3 of the first group G1 and the first to third subfields SF1' to SF3' of the second group G2 are shown. In addition, in FIG. 5, only driving waveforms applied to one A electrode, one X electrode, and Y electrodes $Y_{G1}$ and $Y_{G2}$ of the first and second groups are illustrated. As shown in FIG. 5, the driving waveforms according to the second exemplary embodiment of the present invention are substantially the same as those of the first exemplary embodiment of the present invention except the driving waveforms applied to the first to second subfields SF1, SF1', SF2, and SF2'. Therefore, the corresponding description already provided in reference to the first exemplary embodiment will not be repeated.

Referring to FIG. 5, in the main reset period R1 of the first subfield of the first group, while the reference voltage is applied to the X and A electrodes, the voltage at the Y electrodes $Y_{G1}$ of the first group is gradually increased from the ΔVscH voltage to the Vset1 voltage. In addition, while the reference voltage and the Ve voltage are respectively applied to the A electrodes and the X electrodes, the voltage at the Y electrodes $Y_{G1}$ of the first group is decreased to the Vnf voltage. Since the Vset1 voltage has a level for discharging all the discharge cells, the reset discharge is generated in all the cells of the first group G1 to initialize the cells.

In the main reset period R1 of the first subfield of the first group, the voltage of the Y electrodes $Y_{G2}$ of the second group is gradually increased from the ΔVscH voltage to the Vset1 voltage, and is gradually decreased to the Vnf voltage. Thereby, the reset discharge is generated in the discharge cells of the second group, and the discharge cells are initialized. That is, a main reset period R11' of the first subfield of the second group and the main reset period R1 of the first subfield of the first group are concurrently performed.

In the address period AD1 of the first subfield of the first group, while the Ve voltage is applied to the X electrodes, the scan pulse having the VscL voltage and the address pulse having the Va voltage are respectively applied to the Y electrodes $Y_{G1}$ and the A electrodes of the first group to select light emitting cells from the cells of the first group G1. The Y electrodes that are not selected from the Y electrodes $Y_{G1}$ of the first group are biased at the VscH voltage, and the reference voltage is applied to the A electrodes of the non-light emitting cells. The VscH voltage is applied to the Y electrodes $Y_{G2}$ of the second group. Thereby, light emitting cells are selected only from the cells of the first group G1 in the address period AD1 of the first subfield of the first group.

In the sustain period of the first subfield of the first group, the sustain pulse is alternately applied to the Y electrodes $Y_{G1}$ and $Y_{G2}$ of the first and second groups and the X electrodes. The sustain pulse applied to the Y electrodes $Y_{G1}$ and $Y_{G2}$ and the sustain pulse applied to the X electrodes have opposite phases. Thereby, the sustain-discharge is generated in the cells established as the light emitting cells in the address period AD1 of the first subfield of the first group. That is, the sustain-discharge is generated in the cells established as the light emitting cells from the cells of the first group G1. In addition, the sustain-discharge is not generated in the cells of the second group G1 since they are not established as light emitting cells.

In a reset period R12' of the first subfield of the second group, while the reference voltage is applied to the X and A electrodes, the voltage at the Y electrodes $Y_{G2}$ of the second group is gradually increased from the ΔVscH voltage to the Vset2 voltage. In addition, while the Ve voltage and the reference voltage are respectively applied to the X electrodes and the A electrodes, the voltage at the Y electrodes $Y_{G2}$ of the second group is gradually decreased from the reference voltage to the Vnf voltage. Here, the Vset2 voltage has a level that may discharge the cells that have been sustain-discharged in the previous subfield. Accordingly, since the reset discharge has already been generated in the cells of the second group G2 in the main reset period R11', the reset discharge may not be generated in the reset period R12'. However, the cells that are not appropriately initialized in the main reset period R11' may be initialized in the reset period R12'. As described, in the first subfield SF1', the cells of the second group G2 are initialized in two reset periods R11' and R12'.

In the reset period of the first subfield of the second group, an auxiliary reset period R21 of the second subfield of the first group is performed. In the auxiliary reset period R21 of the second subfield of the first group, the voltage at the Y electrodes $Y_{G1}$ of the first group is gradually increased to the Vset2 voltage, and is gradually decreased to the Vnf voltage. Here, the Vset2 voltage is set to discharge the cells that have been sustain-discharged in the previous subfield. The reset discharge is generated only in the cells that have been sustain-discharged in the previous subfield SF1 among the cells of the first group G1. In addition, the cells that are not established as the light emitting cells and are not sustain-discharged in the previous subfield among the cells of the first group G1 are maintained at the wall charge state of the reset period R1 of the previous subfield. Accordingly, the cells of the first group G1 is initialized in the auxiliary reset period R21 of the second subfield of the first group G1.

In the address period AD1' of the first subfield of the second group, while the Ve voltage is applied to the X electrodes, the scan pulse having the VscL voltage and the address pulse having the Va voltage are respectively applied to the Y electrodes $Y_{G2}$ of the second group and the A electrodes to select light emitting cells from the cells of the second group G2. In addition, the Y electrodes that are not selected from the Y electrodes $Y_{G2}$ of the second group are biased at the VscH voltage, and the reference voltage is applied to the A electrodes of the non-light emitting cells. The VscH voltage is applied to the Y electrodes $Y_{G1}$ of the first group. Thereby, the light emitting cells are selected only from the cells of the second group G2 in the address period AD1' of the first subfield of the second group.

In a sustain period S1' of the first subfield of the second group, the sustain pulse is alternately applied to the Y electrodes $Y_{G1}$ and $Y_{G2}$ and the X electrodes of the first and second groups. In this case, the sustain pulse applied to the Y electrodes $Y_{G1}$ and $Y_{G2}$ and the sustain pulse applied to the X electrodes have opposite phases. Thereby, the sustain-discharge is generated in the cells established as the light emitting cells in the address period AD1' of the first subfield of the second group. That is, the sustain-discharge is generated in the cells established as the light emitting cells among the cells of the second group G2. In addition, since the cells of the first group G1 are initialized not to be established as light emitting cells in the auxiliary reset period R21, the sustain-discharge is not generated in the cells of the first group G1.

In a reset period R22 of the second subfield of the first group, while the reference voltage is applied to the X electrodes and the A electrodes, the voltage at the Y electrodes $Y_{G1}$ of the first group is gradually increased from the ΔVscH voltage to the Vset2 voltage. In addition, while the Ve voltage and the reference voltage are respectively applied to the X electrodes and the A electrodes, the voltage at the Y electrodes $Y_{G1}$ of the first group is gradually decreased from the reference voltage to the Vnf voltage. Since the Vset2 voltage discharges only the cells that have been sustain-discharged in the previous subfield and the cells of the first group G1 have been already initialized in the auxiliary reset period R21, the reset discharge may not be generated in the cells of the first group G1 in the reset period R22. However, the cells that are not appropriately initialized in the auxiliary reset period R21 among the cells of the first group G1 may be initialized in the reset period R22. As described, the cells of the first group G1 are initialized in two reset periods R21 and R22 in the second subfield SF2.

In the reset period R22 of the second subfield of the first group, an auxiliary reset period R21' of the second subfield of the second group is also performed. As shown in FIG. 5, in the reset period R22 of the second subfield of the first group, the voltage at the Y electrodes $Y_{G2}$ of the second group is gradually increased to the Vset2 voltage and is gradually decreased to the Vnf voltage. Since the Vset2 voltage discharges only cells that have been sustain-discharged in the previous subfield, the reset discharge is generated only in the cells that have been sustain-discharged in the previous subfield SF1' among the cells of the second group G2. In addition, the cells that are not established as light emitting cells and have not been sustain-discharged in the previous subfield SF1' among the cells of the second group G2 are maintained at the wall charge state of the reset period R12' of the previous subfield. Accordingly, the cells of the second group G2 are initialized in the auxiliary reset period R21' of the second subfield of the second group G2.

In the address period AD2 of the second subfield of the first group, while the Ve voltage is applied to the X electrodes, the scan pulse having the VscL voltage and the address pulse having the Va voltage are respectively applied to the Y electrodes $Y_{G1}$ of the first group and the A electrodes to select light emitting cells from the cells of the first group G2. In addition, the Y electrodes that are not selected from the Y electrodes $Y_{G1}$ of the first group are biased at the VscH voltage, and the reference voltage is applied to the A electrodes of non-light emitting cells. The VscH voltage is applied to the Y electrodes $Y_{G2}$ of the second group. Thereby, the light emitting cells are selected only from the cells of the first group G1 in the address period AD2 of the second subfield of the first group.

In the sustain period S21 of the second subfield of the first group, the sustain pulse is alternately applied to the Y electrodes $Y_{G1}$ and $Y_{G2}$ of the first and second groups and the X electrodes. In this case, the sustain pulse applied to the Y electrodes $Y_{G1}$ and $Y_{G2}$ and the sustain pulse applied to the X electrodes have opposite phases. Thereby, the sustain-discharge is generated in the cells established as the light emitting cells in the address period AD2 of the second subfield of the first group. That is, the sustain-discharge is generated in the cells established as the light emitting cells among the cells of the first group G1. In addition, since the cells of the second group G2 are initialized in the auxiliary reset period R21' not to be established as light emitting cells, the sustain-discharge is not generated.

In a reset period R22' of the second subfield of the second group, while the reference voltage is applied to the X electrodes and the A electrodes, the voltage at the Y electrodes $Y_{G2}$ of the second group is gradually increased from the ΔVscH voltage to the Vset2 voltage. Subsequently, while the reference voltage and the Ve voltage are respectively applied to the A electrodes and the X electrodes, the voltage at the Y electrodes $Y_{G2}$ of the second group is gradually decreased from the reference voltage to the Vnf voltage. Since the cells of the second group G2 have already been initialized in the auxiliary reset period R21', the reset discharge may not be generated in the reset period R22'. However, the cells that are not appropriately initialized in the auxiliary reset period R21' among the cells of the second group G2 may be initialized in the reset period R22'. As described, in the second subfield SF2', the cells of the second group G2 are initialized in two reset periods R21' and R22'.

In the reset period R22' of the second subfield of the second group, the voltage at the Y electrodes $Y_{G1}$ of the first group is gradually increased to the Vset4 voltage, and is gradually decreased to the Vnf voltage. Here, since the Vset4 voltage has a level that may not generate the reset discharge, the reset discharge is not generated in the cells of the first group G1. Accordingly, the cells of the first group G1 are maintained at the previous light emitting cell state.

In the address period AD2' of the second subfield of the second group, while the Ve voltage is applied to the X electrodes, the scan pulse having the VscL voltage and the address pulse having the Va voltage are respectively applied to the Y electrodes $Y_{G2}$ of the second group and the A electrodes to select light emitting cells from the cells of the second group G2. The Y electrodes that are not selected from the Y electrodes $Y_{G2}$ of the second group are biased at the VscH voltage that is higher than the VscL voltage, and the reference voltage is applied to the A electrodes of the non-light emitting cells. The VscH voltage is applied to the Y electrodes $Y_{G1}$ of the first group. Thereby, light emitting cells are selected only from the cells of the second group G2 in the address period AD2' of the second subfield of the second group.

In the sustain period S21' of the second subfield of the second group, the sustain pulses alternately having the high level voltage Vs and the low level voltage 0V are alternately applied to the Y electrodes $Y_{G1}$ and $Y_{G2}$ of the first and second groups and the X electrodes. In this case, the sustain pulse applied to the Y electrodes $Y_{G1}$ and $Y_{G2}$ and the sustain pulse applied to the X electrodes have opposite phases. Thereby, the sustain-discharge is generated in the cells established as light emitting cells in the address period AD2' of the second subfield of the second group. That is, the sustain-discharge is generated in the cells established as light emitting cells among the cells of the second group G2. Since the cells of the first group G1 are not initialized in the reset period R22' of the second subfield of the second group, the sustain-discharge is generated in the cells established as light emitting cells among the cells of the first group G1 in the address period AD2. That is, the sustain period S22 of the second subfield of the first group is performed in the sustain period S21' of the second subfield of the second group.

Since the driving waveforms applied to the third to eighth subfields are substantially the same as those of the first exemplary embodiment of the present invention, detailed descriptions will be omitted.

As shown in FIG. 4, the sustain period S82' is additionally provided in an eighth subfield SF8' of the second group. In the additional sustain period S82', the waveform having the same phase as the sustain pulse applied to the X electrodes is applied to the Y electrodes $Y_{G1}$ of the first group so that the sustain-discharge is not generated in the cells of the first group G1.

Generally, the problem of low address discharge caused by the loss of wall charges becomes worse when the number of priming particles increase. That is, the problem of low address discharge becomes worse in the subfield having a higher weight value. Accordingly, the sustain-discharge is generated after the address operation is performed for all the cells in the subfield having a low weight value, differing from the first and second exemplary embodiments of the present invention, and the address operation and the sustain operations are performed for each group in the subfield having a high weight value in a like manner as the first and second exemplary embodiments of the present invention, which will be described with reference to FIG. 6 and FIG. 7.

The plasma display according to a third exemplary embodiment of the present invention and a driving method thereof will be described with reference to FIG. 6 and FIG. 7.

Figure 6:
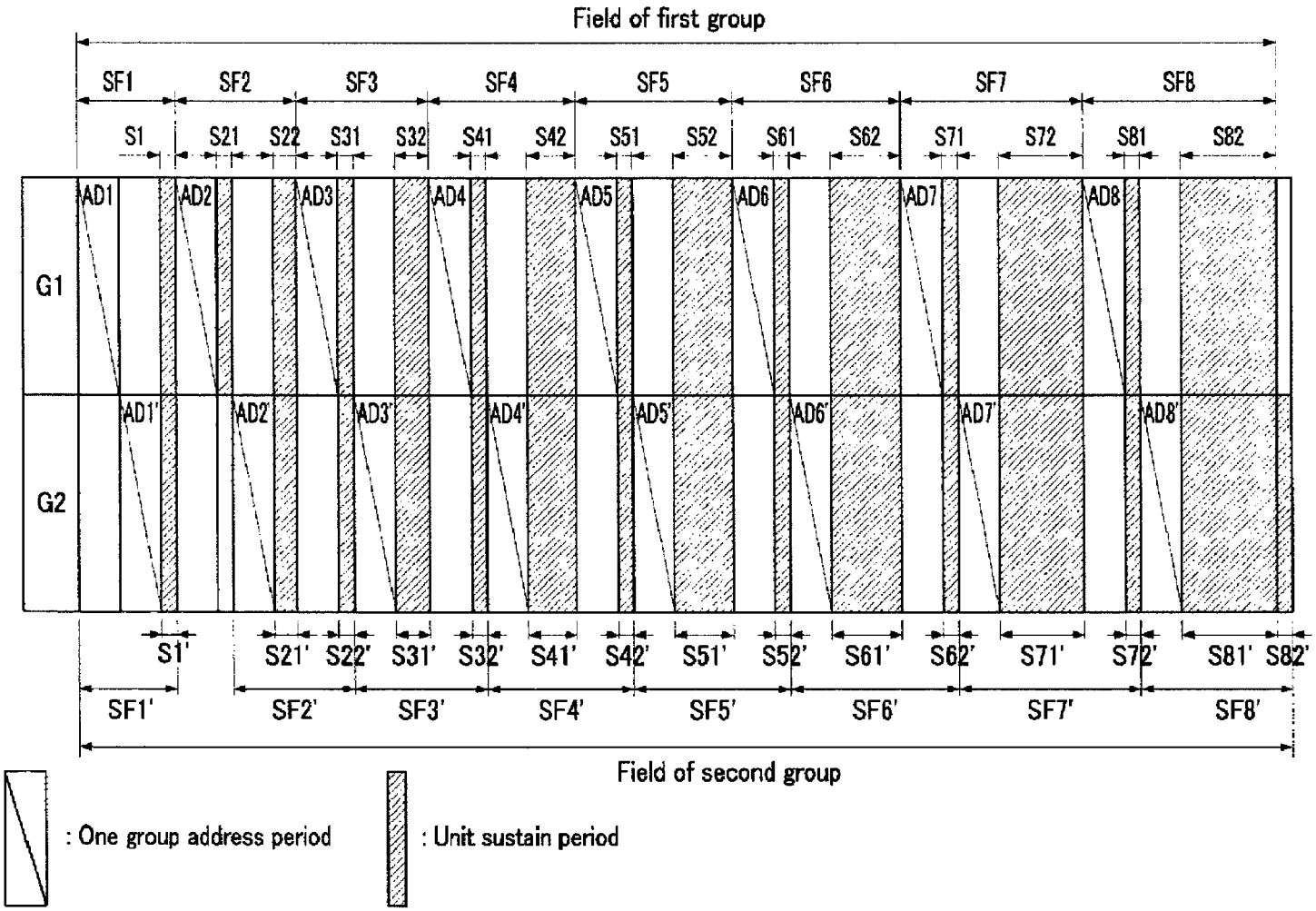
FIG. 6 is a diagram representing a subfield configuration of the plasma display according to a third exemplary embodiment of the present invention.
Figure 7:
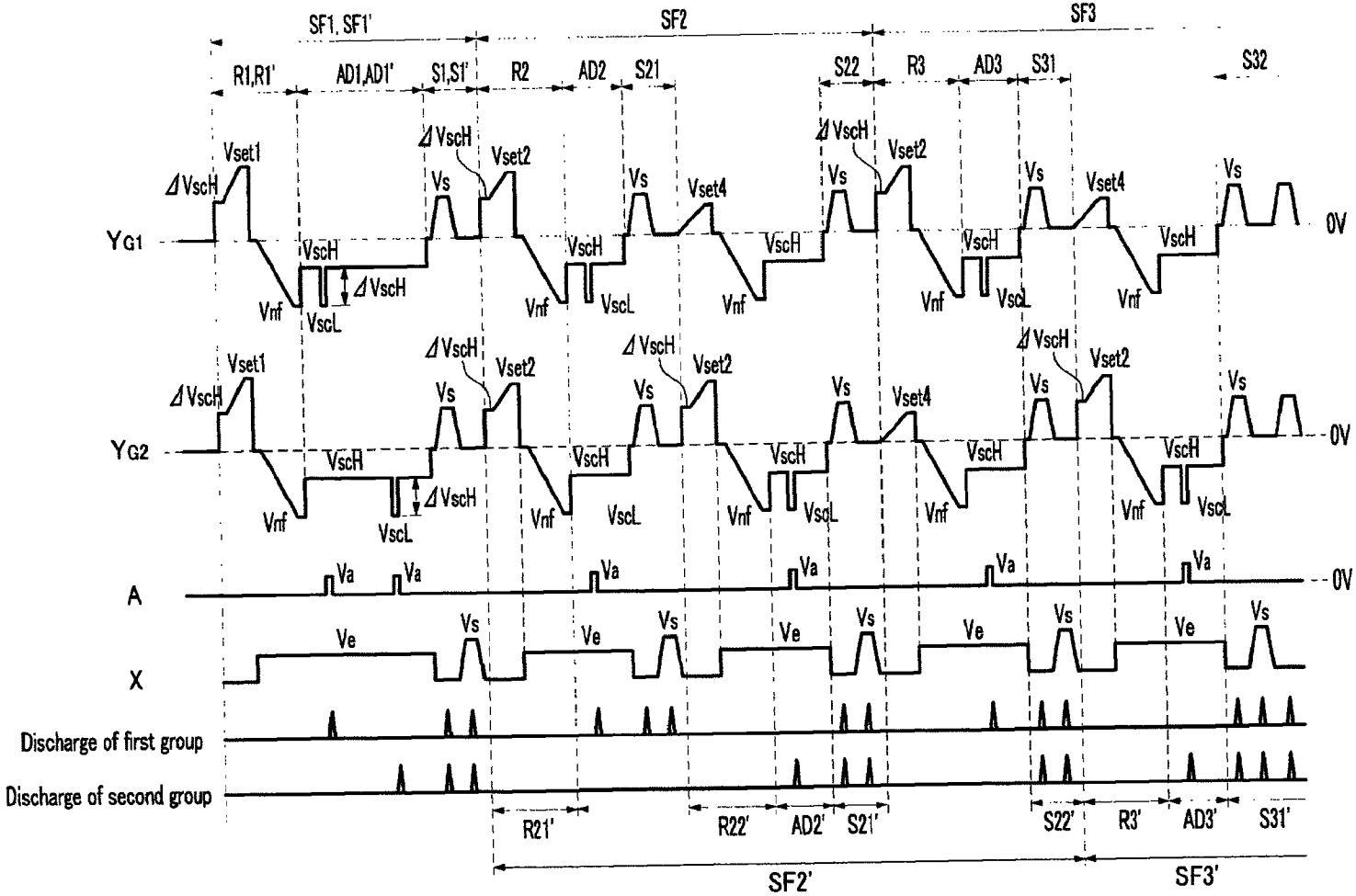
FIG. 7 is a diagram representing driving waveforms applied to the electrodes during the subfield configuration shown in FIG. 6.

FIG. 6 is a diagram representing the subfield configuration of the plasma display according to the third exemplary embodiment of the present invention, and FIG. 7 is a diagram representing the driving waveforms applied to the subfield configuration shown in FIG. 6.

As shown in FIG. 6, since the subfield configuration according to the third exemplary embodiment of the present invention is substantially the same as that of the second exemplary embodiment of the present invention except for the first subfields SF1 and SF1', the corresponding description already provided in reference to the second exemplary embodiment will not be repeated.

Referring to FIG. 6, in the subfield configuration according to the third exemplary embodiment of the present invention, the first subfields SF1 and SF1' of the first and second groups G1 and G2 are simultaneously (or concurrently) performed.

In the first subfields SF1 and SF1', after the address period AD1 for selecting light emitting cells and non-light emitting cells from the cells of the first group G1 is performed, the address period AD1' for selecting light emitting cells and non-light emitting cells from the cells of the second group G2 is performed. Subsequently, the sustain period S1 of the first group G1 and the sustain period S1' of the second group G2 are concurrently performed. That is, after the address operation is performed for the cells of the first and second groups G1 and G2, the sustain periods for the two groups G1 and G2 are concurrently performed.

Remaining subfields SF2 to SF8 have substantially the same configuration as that of the second exemplary embodiment of the present invention. It is illustrated in FIG. 6 that the address periods are performed and then the sustain period is performed for the cells of the first and second groups G1 and G2 only in the first subfields SF1 and SF1', which may be applied to the subfield having a low weight value so that the low address discharge is rarely generated.

Driving waveforms applied to the subfield configuration shown in FIG. 6 will be described with reference to FIG. 7.

In FIG. 7, for convenience of description, some subfields among the plurality of subfields are illustrated for each group. That is, only the first to third subfields SF1 to SF3 of the first group G1 and the first to third subfields SF1' to SF3' of the second group G2 are shown. In addition, in FIG. 7, only driving waveforms applied to one A electrode, one X electrode, and Y electrodes $Y_{G1}$ and $Y_{G2}$ of the first and second groups are illustrated. As shown in FIG. 7, since the driving waveforms according to the third exemplary embodiment of the present invention are substantially the same as those of the second exemplary embodiment of the present invention except the driving waveforms applied to the first subfields SF1 and SF1', the corresponding description already provided in reference to the second exemplary embodiment will not be repeated.

Referring to FIG. 7, in the main reset periods R1 and R1' of the first subfields SF1 and SF1' of the first and second groups, while the reference voltage is applied to the X and A electrodes, the voltages at the Y electrodes $Y_{G1}$ of the first group and the Y electrodes $Y_{G2}$ of the second group are gradually increased from the ΔVscH voltage to the Vset1 voltage. In addition, while the reference voltage and the Ve voltage are respectively applied to the A electrodes and the X electrodes, the voltage at the Y electrodes $Y_{G1}$ of the first group and the Y electrodes $Y_{G2}$ of the second group are decreased from the reference voltage to the Vnf voltage. Since the Vset1 voltage may discharge all the discharge cells, the reset discharge is generated in the cells of the first and second groups G1 and G2 so that the cells are initialized.

In the address period AD1 of the first subfield of the first group, while the Ve voltage is applied to the X electrodes, the scan pulse having the VscL voltage and the address pulse having the Va voltage are respectively applied to the Y electrodes $Y_{G1}$ of the first group and the A electrodes to select light emitting cells from the cells of the first group G1. The Y electrodes that are not selected among the Y electrodes $Y_{G1}$ of the first group are biased at the VscH voltage, and the reference voltage is applied to the A electrodes of non-light emitting cells. In addition, in the address period AD1 of the first subfield of the first group, the VscH voltage is applied to the Y electrodes $Y_{G2}$ of the second group. Thereby, the light emitting cells are selected from the cells of the first group G1 in the address period AD1 of the first subfield of the first group.

Subsequently, in the address period AD1' of the first subfield of the second group, while the Ve voltage is applied to the X electrodes, the scan pulse having the VscL voltage and the address pulse having the Va voltage are respectively applied to the Y electrodes $Y_{G2}$ of the second group and the A electrodes to select light emitting cells from the cells of the second group G2. In addition, the Y electrodes that are not selected from the Y electrodes $Y_{G2}$ of the second group are biased at the VscH voltage, and the reference voltage is applied to the A electrodes of non-light emitting cells. In addition, in the address period AD1' of the first subfield of the second group, the VscH voltage is applied to the Y electrodes $Y_{G1}$ of the first group. Thereby, light emitting cells are selected from the cells of the second group G1 in the address period AD1' of the first subfield of the second group.

In the sustain periods S1 and S1' of the first subfield of the first and second groups, the sustain pulse is alternately applied to the Y electrodes $Y_{G1}$ and $Y_{G2}$ of the first and second groups. In this case, the sustain pulse applied to the Y electrodes $Y_{G1}$ and $Y_{G2}$ and the sustain pulse applied to the X electrodes have opposite phases. Thereby, the sustain-discharge is generated in the cells established as light emitting cells in the address period AD1 of the first subfield of the first group and the address period AD1' of the first subfield of the second group. That is, the sustain-discharge is generated in the cells established as light emitting cells among the cells of the first and second groups G1 and G2.

As described above, since the driving waveforms applied to the second and eighth subfields are the same as those of the second exemplary embodiment of the present invention, detailed descriptions thereof will be omitted.

In the first to third exemplary embodiments of the present invention, periods for increasing and decreasing the voltage at the Y electrode in the auxiliary reset period are provided. The reset discharge is generated only in the cells that have been discharged in the previous subfield during the auxiliary reset period, and the auxiliary reset period may be realized only by a period for decreasing the voltage at the Y electrodes, which will be described with reference to FIG. 8.

Figure 8:
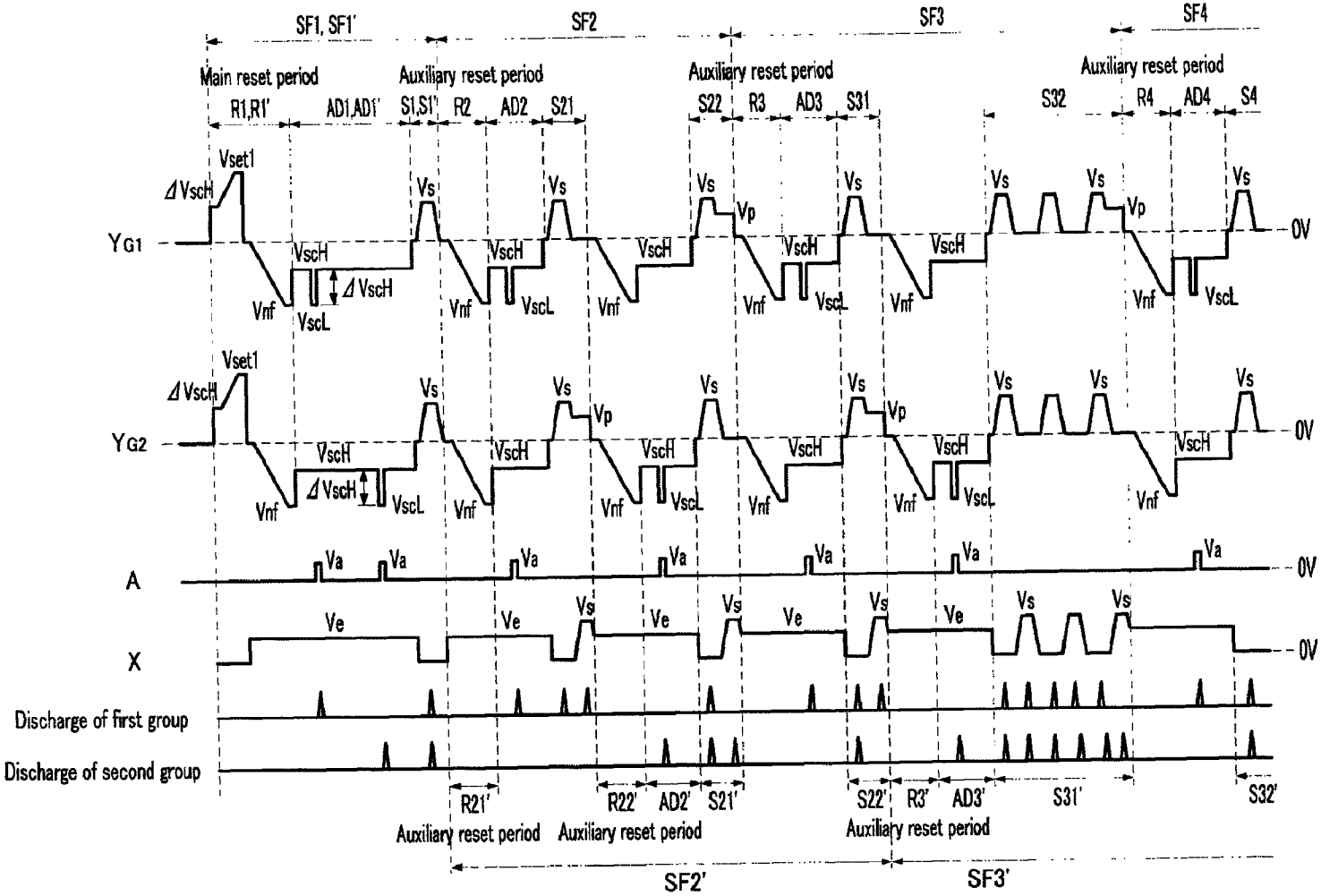
FIG. 8 is a diagram representing driving waveforms of the plasma display according to a fourth exemplary embodiment of the present invention.

FIG. 8 is a diagram representing driving waveforms of the plasma display according to a fourth exemplary embodiment of the present invention. In FIG. 8, for convenience of description, driving waveforms applied to the subfield configuration shown in FIG. 6 are shown, and the subfield configurations shown in FIG. 2 and FIG. 4 may be realized by an auxiliary reset period that will be described now.

As shown in FIG. 8, the driving waveforms applied to the first subfield SF1 of the first group and the first subfield SF1' of the second group are similar to those of the third exemplary embodiment of the present invention. However, in the sustain periods S1 and S1' of the first and second groups, a last sustain pulse is applied to the Y electrodes $Y_{G1}$ and $Y_{G2}$ of the first and second groups rather than being applied to the X electrodes. Generally, the (−) wall charges are required to be formed on the Y electrode to realize the auxiliary reset period in a subsequent subfield. Accordingly, the last sustain pulse is applied to the Y electrodes $Y_{G1}$ and $Y_{G2}$ of the first and second groups, and the (−) wall charges are formed on the Y electrodes by the last sustain pulse.

In the auxiliary reset period R2 of the second subfield of the first group, while the Ve voltage and the reference voltage are respectively applied to the X electrodes and the A electrodes, the voltage at the Y electrodes $Y_{G1}$ of the first group is gradually decreased from the reference voltage to the Vnf voltage. Thereby, the reset discharge is generated only in the cell that has been sustain-discharged in the previous subfield SF1. Since the (−) wall charges are formed on the Y electrodes $Y_{G1}$ of the first group when the sustain periods S1 and S1' are finished, the cells of the first group G1 are initialized by applying a gradually decreasing voltage to the Y electrodes $Y_{G1}$ of the first group.

In addition, the voltage at the Y electrodes $Y_{G2}$ of the second group is gradually decreased from the reference voltage to the Vnf voltage in the auxiliary reset period R2 of the second subfield of the first group. Thereby, the reset discharge is generated in the cells that are sustain-discharged in the previous subfield SF1' among the cells of the second group G1. Accordingly, in the auxiliary reset period R2 of the second subfield of the first group, the auxiliary reset period R21' of the second subfield of the second group is performed in the auxiliary reset period R2 of the second subfield.

In the address period AD2 of the second subfield SF2 of the first group, while the Ve voltage is applied to the X electrodes, the scan pulse having the VscL voltage and the address pulse having the Va voltage are respectively applied to the Y electrodes $Y_{G1}$ of the first group and the A electrodes to select light emitting cells from the cells of the first group G1. In addition, the Y electrodes that are not selected from the Y electrodes $Y_{G1}$ of the first group are biased at the VscH voltage, and the reference voltage is applied to the A electrodes of non-light emitting cells. Further, the VscH voltage is applied to the Y electrodes $Y_{G2}$ of the second group. Thereby, in the address period AD2 of the second subfield of the first group, the light emitting cells are selected from the cells of the first group G1.

Subsequently, in the sustain period S21 of the second subfield of the first group, the sustain pulse is alternately applied to the Y electrodes $Y_{G1}$ and $Y_{G2}$ of the first and second groups and the X electrodes. In this case, the sustain pulse applied to the Y electrodes $Y_{G1}$ and $Y_{G2}$ and the sustain pulse applied to the X electrodes have opposite phases. Thereby, in the address period AD2 of the second subfield of the first group, the sustain-discharge is generated in the cells established as the light emitting cells. That is, the sustain-discharge is generated in the cells established as the light emitting cells among the cells of the first group G1. In addition, the sustain-discharge is not generated in the cells of the second group G2 since it is not established as light emitting cells.

As shown in FIG. 8, in the sustain period S21 of the second subfield of the first group, the last sustain pulse is applied to the X electrodes rather than the Y electrodes, and the reference voltage and a Vp voltage are respectively applied to the Y electrodes $Y_{G1}$ of the first group and the Y electrodes $Y_{G2}$ of the second group. Here, the Vp voltage is established such that the sustain-discharge is not generated in the light emitting cells by a difference between the Vs voltage and the Vp voltage. Accordingly, when the last sustain pulse is applied, the sustain-discharge is generated in the cells of the first group G1, and the sustain-discharge is not generated in the cells of the second group. In addition, since the cells of the second group are not established as light emitting cells, the sustain-discharge is not generated in the cells of the second group when the last sustain pulse is applied.

While the Ve voltage and the reference voltage are respectively applied to the X electrodes and the A electrodes in the auxiliary reset period R22' of the second subfield of the second group, the voltage at the Y electrodes $Y_{G1}$ of the first group and the voltage at the Y electrodes $Y_{G2}$ of the second group are gradually decreased from the reference voltage to the Vnf voltage. Positive (+) wall charges are formed on the Y electrodes $Y_{G1}$ of the first group by applying the last sustain pulse to the X electrodes in the sustain period S21. Accordingly, the reset discharge is not generated in the cells of the first group G1 in the auxiliary reset period R22' of the second subfield of the second group, and therefore the cells of the first group G1 are not initialized. In addition, since the cells of the second group G2 have already been initialized in the auxiliary reset period R21', the reset discharge is not generated therein in the auxiliary reset period R22'. However, the cells that are not appropriately initialized in the auxiliary reset period R21' among the cells of the second group G2 may be initialized in the reset period R22'.

In the address period AD2' of the second subfield of the second group, while the Ve voltage is applied to the X electrodes, the scan pulse having the VscL voltage and the address pulse having the Va voltage are respectively applied to the Y electrodes $Y_{G2}$ of the second group and the A electrodes to select the light emitting cells from the cells of the second group G2. In addition, the Y electrodes that are not selected from the Y electrodes $Y_{G2}$ of the second group is biased at the VscH voltage, and the reference voltage is applied to the A electrodes of the non-light emitting cells. The VscH voltage is applied to the Y electrodes $Y_{G1}$ of the first group. Thereby, the light emitting cells are selected only from the cells of the second group G2 in the address period AD2' of the second subfield of the second group.

In the sustain period S21' of the second subfield of the second group, the sustain pulse is alternately applied to the Y electrodes $Y_{G1}$ and $Y_{G2}$ of the first and second groups and the X electrodes. In this case, the sustain pulse applied to the Y electrodes $Y_{G1}$ and $Y_{G2}$ and the sustain pulse applied to the X electrodes have opposite phases. Thereby, the sustain-discharge is generated in the cells established as light emitting cells in the address period AD2' of the second subfield of the second group. That is, the sustain-discharge is generated in the cells established as light emitting cells among the cells of the second group G2. In addition, since the cells established as the light emitting cells in the address period AD2 among the cells of the first group G2 are maintained at the light emitting state, the sustain-discharge is generated therein in the sustain period S21'. That is, the sustain period S21' and the sustain period S22 are performed together.

In addition, as shown in FIG. 8, the last sustain pulse is applied to the X electrodes in the sustain period S21' of the second subfield of the second group, the Vp voltage and the reference voltage are respectively applied to the Y electrodes $Y_{G1}$ of the first group and the Y electrodes $Y_{G2}$ of the second group. Accordingly, when the last sustain pulse is applied, the sustain-discharge is not generated in the cells of the first group G1, and the sustain-discharge is generated in the cells of the second group G2. By the last sustain-discharge, while the (−) wall charges are formed on the Y electrodes $Y_{G2}$ of the second group, the (+) wall charges are formed on the Y electrodes $Y_{G1}$ of the first group. In addition, the number of sustain-discharges between the first and second groups varies according to the Vp voltage.

In a reset period R3 of the third subfield of the first group, while the Ve voltage and the reference voltage are respectively applied to the X electrodes and the A electrodes, the voltage at the Y electrodes $Y_{G1}$ of the first group and the voltage at the Y electrodes $Y_{G2}$ of the second group are gradually decreased from the reference voltage to the Vnf voltage. As described, when the sustain period S21' is finished, the (−) wall charges are formed on the Y electrodes $Y_{G1}$ of the first group and the (+) wall charges are formed on the Y electrodes $Y_{G2}$ of the second group. Since the (−) wall charges are formed on the Y electrodes $Y_{G1}$ of the first group, the reset discharge is generated in the cells that are sustain-discharged in the previous subfield SF2 among the cells of the first group G1 in the reset period R3 of the third subfield of the first group. However, since the (+) wall charges are formed on the Y electrodes $Y_{G2}$ of the second group, the reset discharge is not generated in the cells of the second group G2 in the reset period R3 of the third subfield of the first group. That is, the cells of the first group G1 are initialized in the reset period R3 of the third subfield of the first group.

As described, according to the fourth exemplary embodiment of the present invention, the gradually decreasing voltage is applied to the Y electrodes to realize the auxiliary reset period, and the sustain pulse that is finally applied in a previous subfield is adjusted to selectively generate the reset discharge in the cells of the first group G1 and the cells of the second group G2 in the auxiliary reset period. That is, in an auxiliary reset period R3' of the third subfield of the second group, to generate the reset discharge in the cells of the second group G2, the sustain pulse is finally applied to the X electrodes and the Vp voltage is applied to the Y electrodes $Y_{G2}$ of the second group in a sustain period S22' of a previous subfield SF2'. In addition, in an auxiliary reset period R4 of the fourth subfield of the first group, to generate the reset discharge in the cells of the first group G1, the sustain pulse is finally applied to the X electrodes and the Vp voltage is applied to the Y electrodes $Y_{G1}$ of the first group in a sustain period S32 of the previous subfield SF3. The number of sustain-discharges between the first and second groups may be adjusted by applying the Vp voltage.

Since the driving waveforms applied in remaining periods are similar to those applied to the subfields SF1, SF1', SF2, and SF2', detailed descriptions thereof will be omitted.

According to the exemplary embodiment of the present invention, different reset waveforms are simultaneously (or concurrently) applied to the Y electrodes $Y_{G1}$ of the first group and the Y electrodes $Y_{G2}$ of the second group in some of the reset periods. A method for generating the reset waveforms by one driving circuit will now be described.

Figure 9:
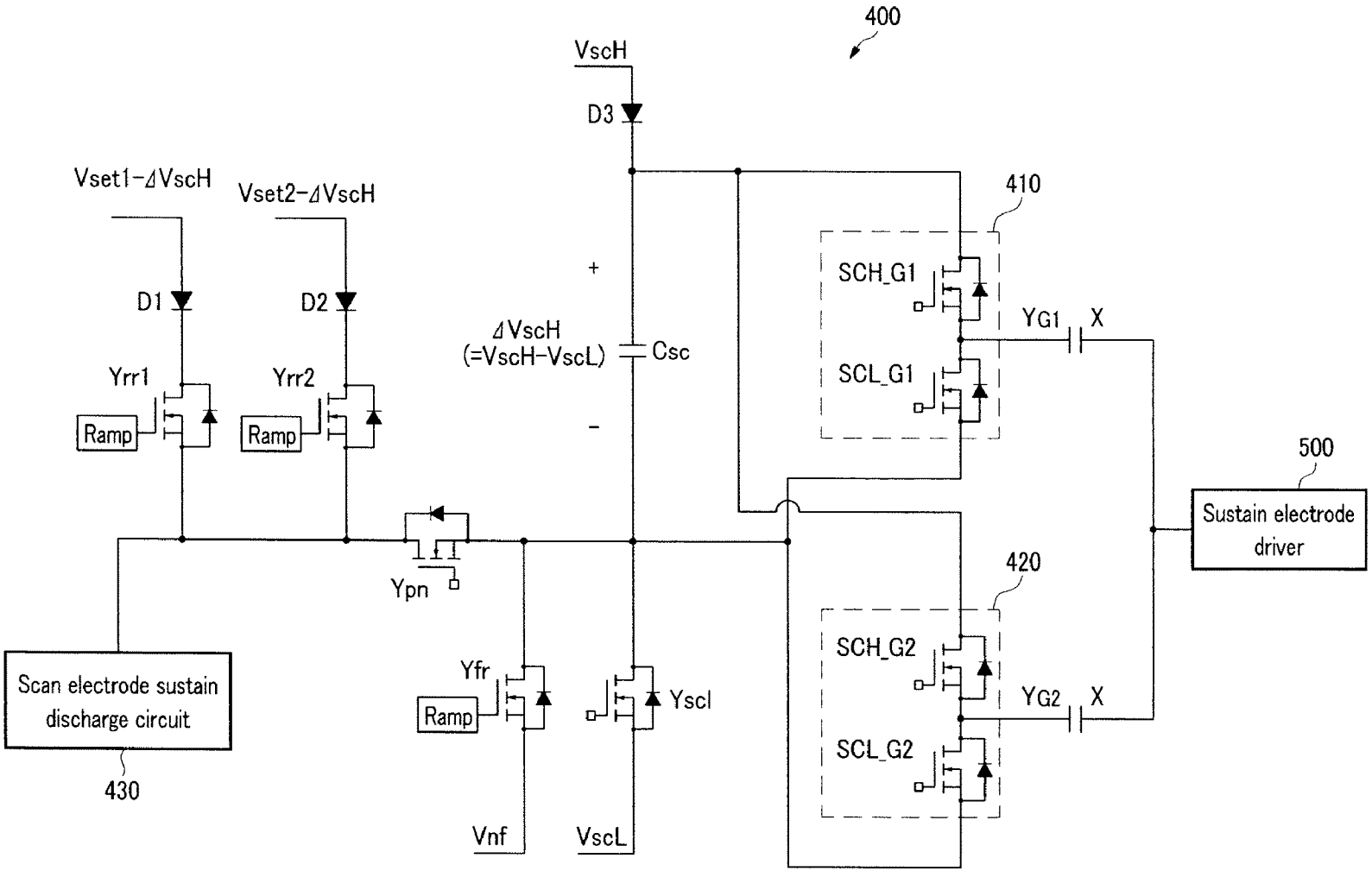
FIG. 9 is a schematic diagram of a circuit configuration of the scan electrode driver according to an exemplary embodiment of the present invention.

FIG. 9 is a schematic diagram of a circuit configuration of the scan electrode driver 400 according to an exemplary embodiment of the present invention. For convenience of description, a circuit part for applying the reset waveform is shown in FIG. 9.

As shown in FIG. 9, the scan electrode driver 400 according to the exemplary embodiment of the present invention includes a first group selection circuit 410, a second group selection circuit 420, a scan electrode sustain-discharge circuit 430, a capacitor Csc, diodes D1, D2, and D3, and transistors Yrr1, Yrr2, Ypn, Yfr, and Yscl.

While a first group scan integrated circuit (IC) includes a plurality of selection circuits respectively coupled to the Y electrodes $Y_{G1}$ of the first group, only the selection circuit 410 coupled to one scan electrode (Y electrode) among the Y electrodes $Y_{G1}$ of the first group is shown in FIG. 9 for convenience of description. In addition, while a second group scan IC includes a plurality of selection circuits respectively coupled to the Y electrodes $Y_{G2}$ of the second group, only the selection circuit 420 connected to one scan electrode (Y electrode) among the Y electrodes $Y_{G2}$ of the second group in FIG. 9 will be described for convenience of description. As shown in FIG. 9, one selection circuit includes two transistors, a source and a drain of the two transistors are coupled to each other, and a node thereof is connected to one scan electrode. That is, the first group selection circuit 410 includes two transistors SCH_G1 and SCL_G1, a source of the transistor SCH_G1 and a drain of the transistor SCL_G1 are coupled to each other, and a node of the source and the drain is coupled to the Y electrode $Y_{G1}$ of the first group. In addition, the second group selection circuit 420 includes two transistors SCH_G2 and SCL_G2, a source of the transistor SCH_G2 and a drain of the transistor SCL_G2 are coupled to each other, and a node of the drain and the source is coupled to the Y electrode $Y_{G2}$ of the first group.

A drain of the transistor SCH_G1 and a drain of the transistor SCH_G2 are coupled to one terminal of the capacitor Csc, and a source of the transistor SCL_G1 and a source of the transistor SCL_G2 are coupled to another terminal of the capacitor Csc. A power source VscH for supplying the VscH voltage is coupled to an anode of the diode D3, and the terminal of the capacitor Csc is coupled to a cathode of the diode D3.

A drain and a source of the transistor Yscl are respectively coupled to the other terminal of the capacitor Csc and a power source VscL for supplying the VscL voltage. The transistor Yscl is turned on in the address period to supply the VscL voltage to the scan electrode. A drain and a source of the transistor Yfr are respectively coupled to the other terminal of the capacitor Csc and a power source for supplying the Vnf voltage.

A source of the transistor Ypn is coupled to the other terminal of the capacitor Csc, and sources of the transistors Yrr1 and Yrr2 are coupled to a drain of the transistor Ypn. A drain of the transistor Yrr2 is coupled to a cathode of the diode D2, and an anode of the diode D2 is coupled to a power source (Vset2−ΔVscH) for supplying a voltage of (Vset2−ΔVscH). A drain of the transistor Yrr1 is coupled to a cathode of the diode D1, and an anode of the diode D1 is coupled to a power source (Vset1−ΔVscH) for supplying a voltage of (Vset1−ΔVscH).

Here, the diodes D1, D2, and D3 allow currents to respectively flow from the power sources (Vset1−ΔVscH), (Vset2−ΔVscH), and VscH in one direction. The transistor Ypn interrupts the current that may flow to the scan electrode sustain-discharge circuit 430 when the transistor Yfr or the transistor Yscl is turned on. The transistors Yrr1 and Yrr2 are ramp switches for gradually increasing the voltage at the Y electrode, and the transistor Yfr is a ramp switch for gradually decreasing the voltage at the Y electrode. To perform a ramp switch function, a driving circuit of the transistors Yrr1, Yrr2, and Yfr is connected to a ramp circuit (e.g., a predetermined ramp circuit).

In addition, the scan electrode sustain-discharge circuit 430 generates the sustain pulse applied to the Y electrodes in the sustain period, which is well known to a person of ordinary skill in the art, and therefore detailed description thereof will be omitted A method for simultaneously (or concurrently) applying the different reset waveforms to the first group scan electrodes $Y_{G1}$ and the second group scan electrodes $Y_{G2}$ by using the circuit shown in FIG. 9 will be described with reference to FIG. 10A, FIG. 10*b*, FIG. 11*a*, and FIG. 11*b*.

Figure 10A:
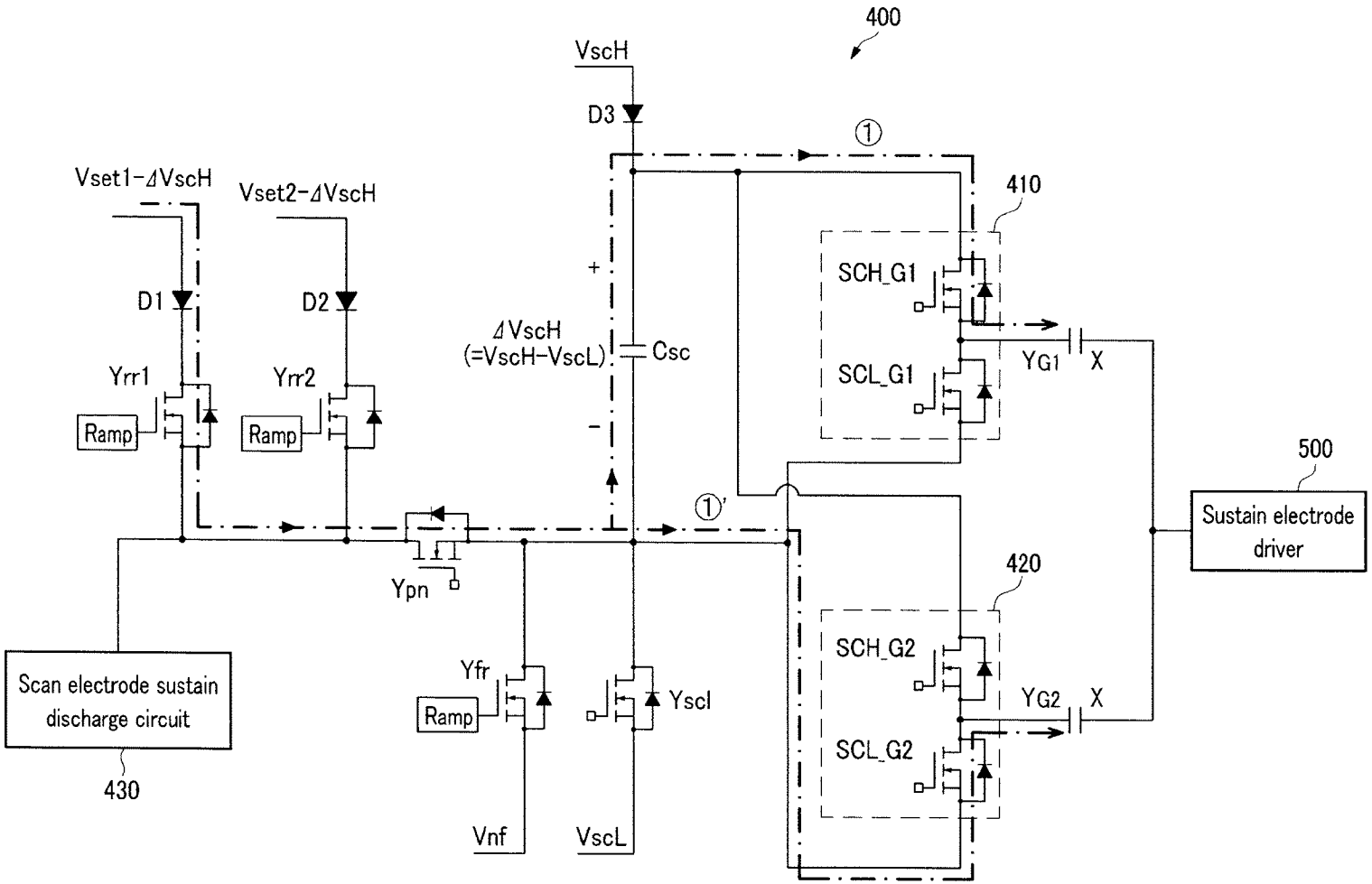
FIG. 10A is a diagram representing a method for generating a reset waveform applied to Y electrodes $Y_{G1}$ and $Y_{G2}$ of first and second groups in a main reset period R1 shown in FIG. 3.

FIG. 10A is a diagram representing a method for generating the reset waveform applied to the Y electrodes $Y_{G1}$ and $Y_{G2}$ of the first and second groups in the main reset period R1 shown in FIG. 3. That is, FIG. 10A shows a method for applying the reset waveform gradually increasing to the Vset1 voltage to the Y electrode $Y_{G1}$ of the first group and the reset waveform gradually decreasing to the Vset3 voltage to the Y electrode $Y_{G2}$ of the second group.

It is assumed that the capacitor Csc is charged with the ΔVscH voltage (VscH−VscL) by turning on the transistor Yscl before the reset waveform is applied.

As shown in FIG. 10A, the transistor Yrr1, the transistor Ypn, the transistor SCH_G1 of the first group selection circuit 410, and the transistor SCL_G2 of the second group selection circuit 420 are turned on.

When the transistors Yrr1, Ypn, and SCH_G1 are turned on, a current path ① shown in FIG. 10A of the power source (Vset1−ΔVscH), the diode D1, the transistor Yrr1, the transistor Ypn, the capacitor Csc, the transistor SCH_G1, and the Y electrode $Y_{G1}$ of the first group is formed. A current (e.g., a predetermined current) may flow through the transistor Yrr1, and the voltage at the Y electrode is gradually increased by the current. Accordingly, through the current path ①, the voltage at the Y electrode $Y_{G1}$ of the first group is added by the voltage charged in the capacitor Csc to be gradually increased from the ΔVscH voltage to the Vset1 voltage.

In addition, when the transistors Yrr1, Ypn, and SCL_G2 are turned on, a current path ①' shown in FIG. 10A of the power source (Vset1−ΔVscH), the diode D1, the transistor Yrr1, the transistor Ypn, the transistor SCL_G2, and the Y electrode $Y_{G2}$ of the second group is formed. Through the current path ①', the voltage at the Y electrode $Y_{G2}$ of the second group is gradually increased from the reference voltage to the voltage of (Vset1−ΔVscH). As described with reference to FIG. 3, since the voltage of (Vset1−ΔVscH) is the Vset3 voltage, the voltage at the Y electrode $Y_{G2}$ of the second group is gradually increased from the reference voltage to the Vset3 voltage.

Figure 10B:
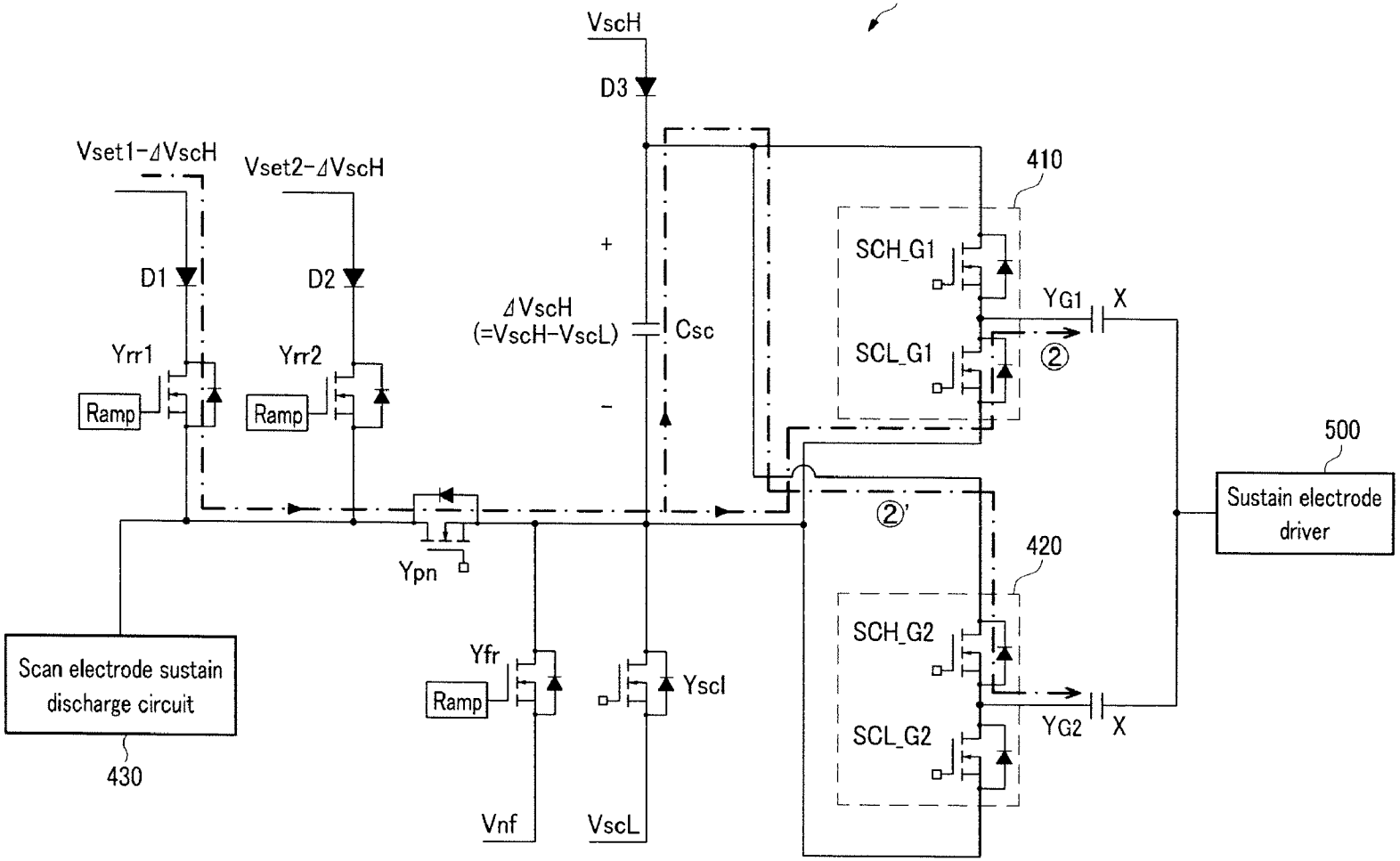
FIG. 10B illustrates a method for generating a reset driving waveform applied to the Y electrodes $Y_{G1}$ and $Y_{G2}$ of the first and second groups in the reset period R1' shown in FIG. 3.

FIG. 10B is a method for generating the reset driving waveform applied to the Y electrodes $Y_{G1}$ and $Y_{G2}$ of the first and second groups in the reset period R1' shown in FIG. 3. That is, FIG. 10B shows a method for applying the reset waveform gradually increasing to the Vset1 voltage to the Y electrode $Y_{G2}$ of the second group and the reset waveform gradually increasing to the Vset3 voltage to the Y electrode $Y_{G1}$ of the first group.

As shown in FIG. 10B, the transistor Yrr1, the transistor Ypn, the transistor SCL_G1 of the first group selection circuit 410, and the transistor SCH_G2 of the second group selection circuit 420 are turned on.

When the transistors Yrr1, Ypn, and SCL_G1 are turned on, a current path ②' shown in FIG. 10B of the power source (Vset1−ΔVscH), the diode D1, the transistor Yrr1, the transistor Ypn, the transistor SCL_G1, and the Y electrode $Y_{G1}$ of the first group is formed. Through the current path ②, the voltage at the Y electrode $Y_{G1}$ of the first group is gradually increased from the reference voltage to the Vset3 voltage (i.e., Vset1−ΔVscH).

When the transistors Yrr1, Ypn, and SCH_G2 are turned on, a current path ②' shown in FIG. 10B of the power source (Vset1−ΔVscH), the diode D1, the transistor Yrr1, the transistor Ypn, the capacitor Csc, the transistor SCH_G2, and the Y electrode $Y_{G2}$ of the second group is formed. Through the current path ②', the voltage at the Y electrode $Y_{G2}$ of the second group is gradually increased from the ΔVscH to the Vset1 voltage.

Figure 11A:
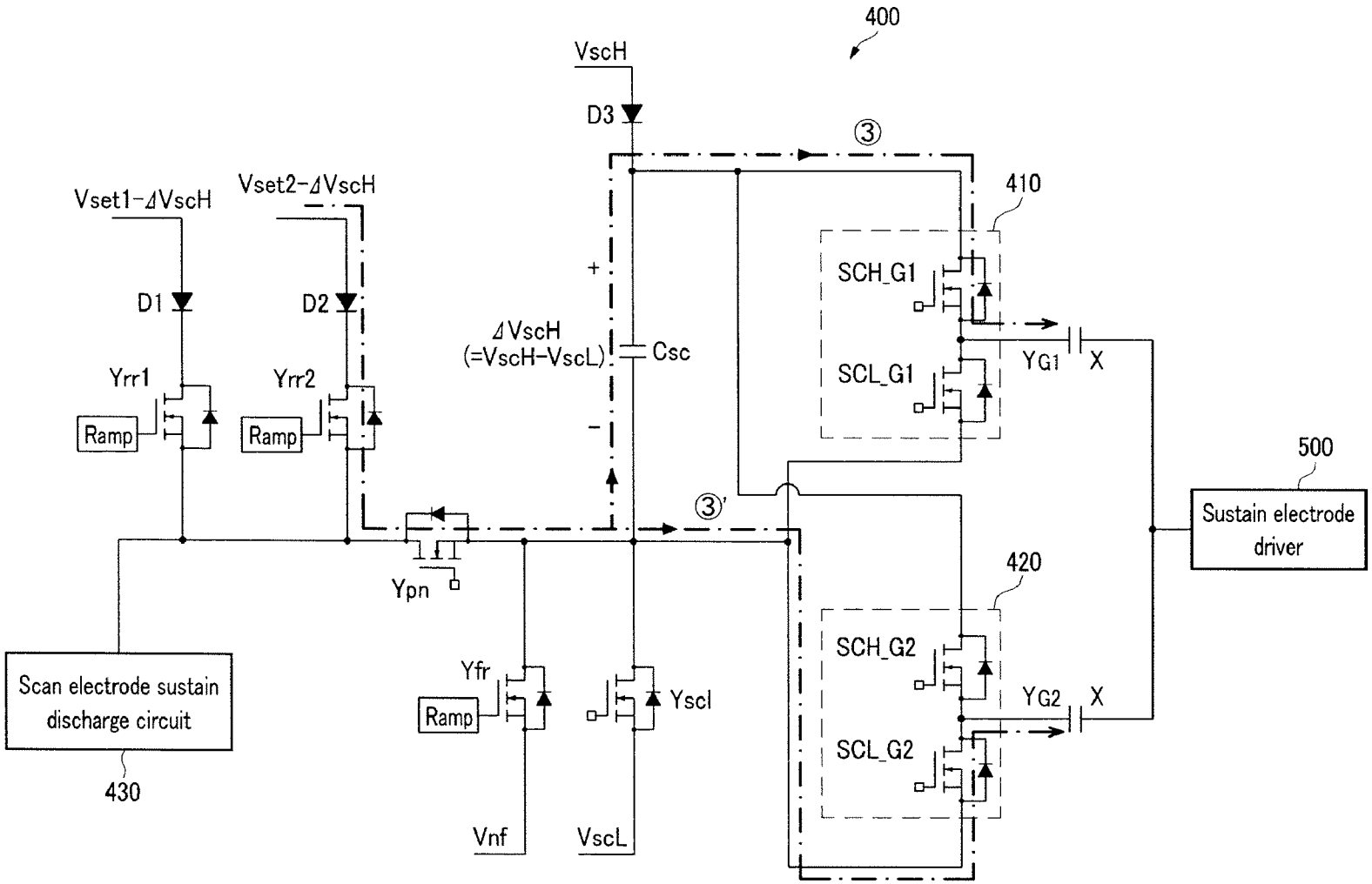
FIG. 11A is a diagram representing a method for generating a reset driving waveform applied to the Y electrodes $Y_{G1}$ and $Y_{G2}$ of the first and second groups in an auxiliary reset period R2 shown in FIG. 3.

FIG. 11A is a diagram representing a method for generating the reset driving waveform applied to the Y electrodes $Y_{G1}$ and $Y_{G2}$ of the first and second groups in the auxiliary reset period R2 shown in FIG. 3. That is, FIG. 11A shows a method for applying the reset waveform gradually increasing to the Vset2 voltage to the Y electrode $Y_{G1}$ of the first group and the reset waveform gradually increasing to the Vset4 voltage to the Y electrode $Y_{G2}$ of the second group.

As shown in FIG. 11A, the transistor Yrr2, the transistor Ypn, the transistor SCH_G1 of the first group selection circuit 410, and the transistor SCL_G2 of the second group selection circuit 420 are turned on.

When the transistors Yrr2, Ypn, and SCH_G1 are turned on, a current path ③ shown in FIG. 11A of the power source (Vset2−ΔVscH), the diode D2, the transistor Yrr2, the transistor Ypn, the capacitor Csc, the transistor SCH_G1, and the Y electrode $Y_{G1}$ of the first group is formed. A current (e.g., predetermined current) may flow through the transistor Yrr2, and the voltage at the Y electrode is gradually increased by the current. Accordingly, through the current path ③, the voltage at the Y electrode $Y_{G1}$ of the first group is added by the voltage charged in the capacitor Csc to be gradually increased from the ΔVscH voltage to the Vset2 voltage.

When the transistors Yrr2, Ypn, and SCL_G2 are turned on, a current path ③' shown in FIG. 11A of the power source (Vset2−ΔVscH), the diode D2, the transistor Yrr2, the transistor Ypn, the transistor SCL_G2, and the Y electrode $Y_{G2}$ of the second group is formed. Through the current path ③', the voltage at the Y electrode $Y_{G2}$ of the second group is gradually increased from the reference voltage to the voltage of (Vset2−ΔVscH). As described with reference to FIG. 3, since the voltage of (Vset2−ΔVscH) is the Vset4 voltage, the voltage at the Y electrode $Y_{G2}$ of the second group is gradually increased from the reference voltage to the Vset4 voltage.

Figure 11B:
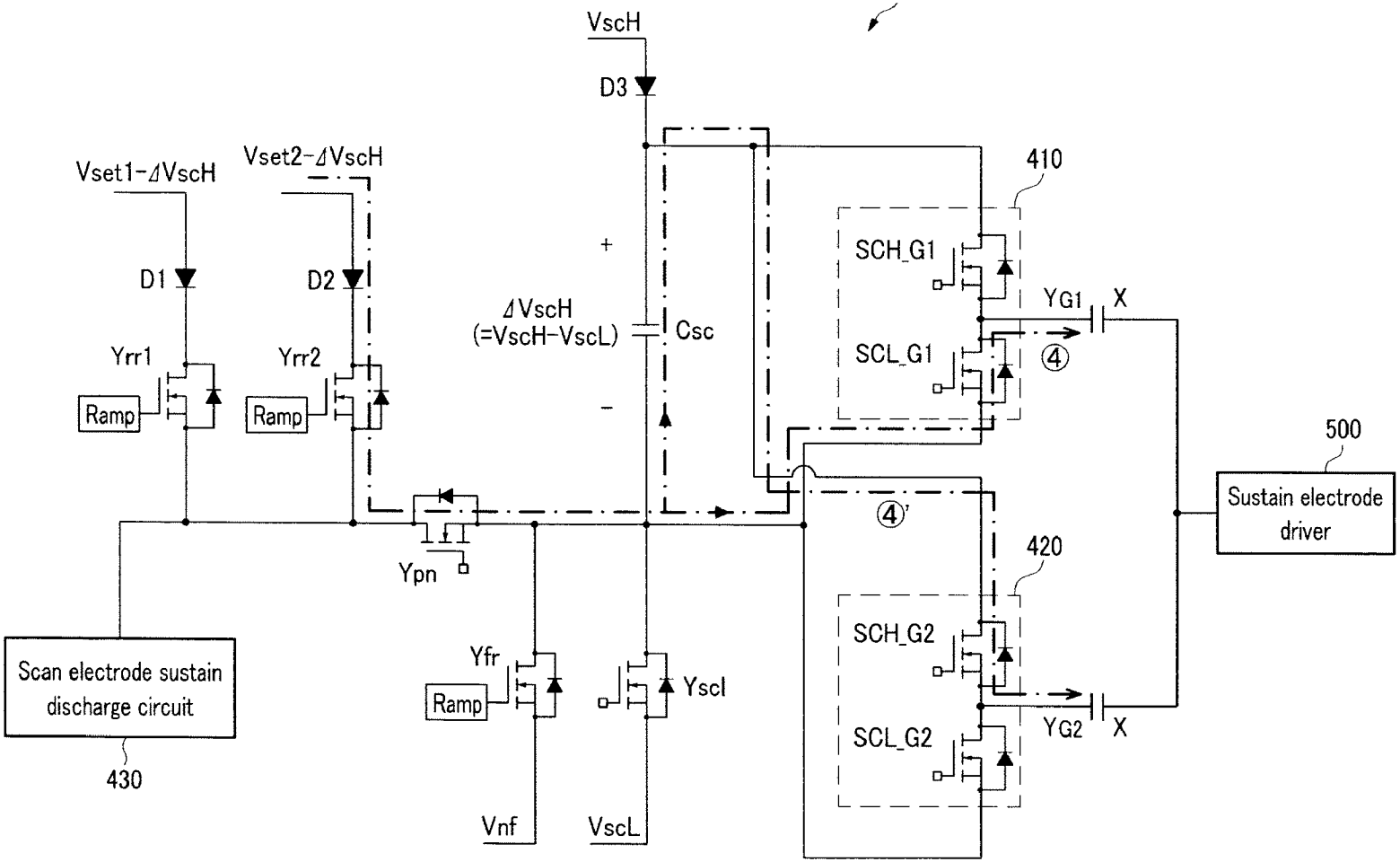
FIG. 11B is a diagram representing a method for generating a reset driving waveform applied to the Y electrodes $Y_{G1}$ and $Y_{G2}$ of the first and second groups an auxiliary reset period R2' shown in FIG. 3.

FIG. 11B is a diagram representing a method for generating the reset driving waveform applied to the Y electrodes $Y_{G1}$ and $Y_{G2}$ of the first and second groups in the auxiliary reset period R2' shown in FIG. 3. That is, FIG. 11B shows a method for generating the reset waveform gradually increasing to the Vset2 voltage to the Y electrode $Y_{G2}$ of the second group and the reset waveform gradually increasing to the Vset4 voltage to the Y electrode $Y_{G1}$ of the first group.

As shown in FIG. 11B, the transistor Yrr2, the transistor Ypn, the transistor SCL_G1 of the first group selection circuit 410, and the transistor SCH_G2 of the second group selection circuit 420 are turned on.

When the transistors Yrr2, Ypn, and SCL_G1 are turned on, a current path ④ shown in FIG. 11B of the power source (Vset2−ΔVscH), the diode D1, the transistor Yrr2, the transistor Ypn, the transistor SCL_G1, and the Y electrode $Y_{G1}$ of the first group is formed. Through the current path ④, the voltage at the Y electrode $Y_{G1}$ of the first group is gradually increased from the reference voltage to the Vset4 voltage (i.e., Vset2−ΔVscH).

In addition, when the transistors Yrr2, Ypn, and SCH_G2 are turned on, a current path ④' shown in FIG. 11B of the power source (Vset2−ΔVscH), the diode D1, the transistor Yrr2, the transistor Ypn, the capacitor Csc, the transistor SCH_G2, and the Y electrode $Y_{G2}$ of the second group is formed. Through the current path ④', the voltage at the Y electrode $Y_{G2}$ of the second group is gradually increased from the ΔVscH voltage to the Vset2 voltage.

In addition, as shown in FIG. 3, the reset waveform applied to the scan electrode includes a gradually increasing part and a gradually decreasing part. The gradually increasing part is the same as those of the method described with reference to FIG. 10A, FIG. 10B, FIG. 11A, and FIG. 11B, in which the waveform is differently applied to the Y electrode $Y_{G1}$ of the first group and the Y electrode $Y_{G2}$ of the second group. The gradually decreasing part is the same in the Y electrode $Y_{G1}$ of the first group and the Y electrode $Y_{G2}$ of the second group, which will be described with reference to FIG. 12.

Figure 12:
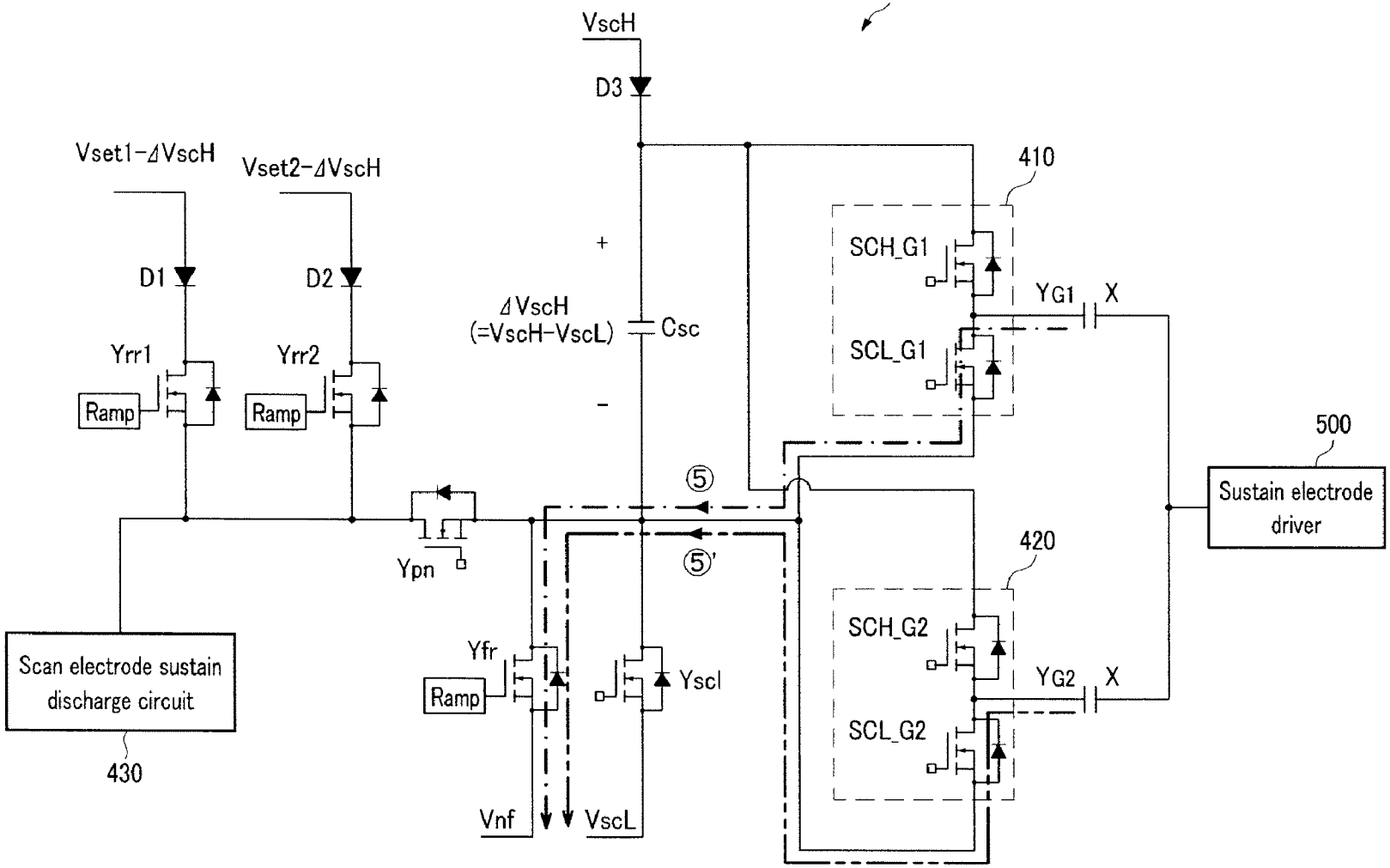
FIG. 12 is a diagram representing a method for generating a gradually decreasing voltage to the Y electrodes $Y_{G1}$ and $Y_{G2}$ of the first and second groups.

FIG. 12 is a diagram representing a method for generating a gradually decreasing voltage to the Y electrodes $Y_{G1}$ and $Y_{G2}$ of the first and second groups. That is, FIG. 12 shows a method for applying the reset waveform gradually decreasing to the Vnf voltage to the Y electrodes $Y_{G1}$ and $Y_{G2}$ of the first and second groups.

As shown in FIG. 12, the transistor Yfr, the transistor SCL_G1 of the first group selection circuit 410, and the transistor SCL_G2 of the second group selection circuit 420 are turned on.

When the transistors Yfr and SCL_G1 are turned on, a current path ⑤ shown in FIG. 12 of the Y electrode $Y_{G1}$ of the first group, the transistor SCL_G1, the transistor Yfr, and the power source Vnf is formed. A current (e.g., a predetermined current) may flow through the transistor Yfr, and the voltage at the Y electrode is gradually decreased by the current. Accordingly, the current path ⑤, the voltage at the Y electrode $Y_{G1}$ of the first group is gradually decreased from the reference voltage to the Vnf voltage.

In addition, when the transistors Yfr and SCL_G2 are turned on, a current path ⑤' shown in FIG. 12 of the Y electrode $Y_{G2}$ of the second group, the transistor SCL_G2, the transistor Yfr, and the power source Vnf is formed. Through the current path ⑤, the voltage at the Y electrode $Y_{G2}$ of the second group is gradually decreased from the reference voltage to the Vnf voltage.

In addition, in a like manner as the main reset period R1 shown in FIG. 5, the voltage gradually increasing from the ΔVscH voltage to the Vset voltage may be applied to the Y electrodes $Y_{G1}$ and $Y_{G2}$ of the first and second groups by the circuit shown in FIG. 9. In the circuit shown in FIG. 9, the transistor Yrr1, the transistor Ypn, the transistor SCH_G1, and the transistor SCH_G2 are turned on. Thereby, the voltages at the Y electrodes $Y_{G1}$ and $Y_{G2}$ of the first and second groups are simultaneously (or concurrently) increased to the Vset1 voltage.

As described, in the scan electrode driver 400 shown in FIG. 9 according to the exemplary embodiment of the present invention, the same reset waveforms or different reset waveforms may be applied to the Y electrode $Y_{G1}$ and the Y electrode $Y_{G2}$ of the first and second groups by appropriately controlling the first group selection circuit 410 and the second group selection circuit 420.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

According to the exemplary embodiment of the present invention, since the plurality of scan electrodes are divided into groups, a time from after the reset period to before the address period may be reduced. Accordingly, the low address discharge may be prevented. In addition, since the respective groups are selectively reset by using the selection circuit of each group reset, it is not required to additionally provide the driving circuit.

What is claimed is:

1. A method for driving a plasma display comprising a plurality of first electrodes having at least a first group and a second group, a plurality of second electrodes crossing the plurality of first electrodes, and a plurality of cells comprising first group cells and second group cells, the method comprising:

initializing the first group cells corresponding to the first electrodes of the first group during a first period;

selecting first group light emitting cells from the first group cells during a second period;

during a third period, sustain-discharging the first group light emitting cells selected during the second period;

initializing the second group cells corresponding to the first electrodes of the second group during a fourth period;

selecting second group light emitting cells from the second group cells during a fifth period; and during a sixth period, sustain-discharging the second group light emitting cells selected during the fifth period, wherein the initializing of the first group cells comprises applying a first waveform gradually increasing from a first voltage to a second voltage and gradually decreasing to a third voltage to the first electrodes of the first group, and applying a second waveform gradually increasing to a fourth voltage and gradually decreasing to a fifth voltage to the first electrodes of the second group, and the second voltage is higher than the fourth voltage, and wherein the initializing of the second group cells comprises applying the first waveform to the first electrodes of the second group and applying the second waveform to the first electrodes of the first group during the fourth period, and the first group cells are not initialized during the fourth period.

2. The method of claim 1, wherein the first group cells are not initialized during the fourth period, and the first group light emitting cells are sustain-discharged during the sixth period.

3. The method of claim 2, further comprising:

initializing the first group cells during a seventh period;

selecting eighth period first group light emitting cells from the first group cells during an eighth period; and during a ninth period, sustain-discharging the eighth period first group light emitting cells selected during the eighth period, wherein the second group cells are not initialized during the seventh period, and the second group light emitting cells are sustain-discharged during the ninth period.

4. The method of claim 3, wherein a number of sustain-discharges generated during the third period is the same as a number of the sustain-discharges generated during the ninth period.

5. The method of claim 3, wherein the first to ninth periods are sequential periods.

6. The method of claim 3, wherein the plasma display further comprises a plurality of third electrodes extending in a same direction as the plurality of first electrodes, wherein a last sustain-discharge is generated in the second group light emitting cells since a sixth voltage and a seventh voltage which is lower than the sixth voltage are respectively applied to the first electrodes of the first group and the first electrodes of the second group while an eighth voltage is applied to the plurality of third electrodes during the sixth period, wherein a voltage at the first electrodes of the first and second groups is gradually decreased to a ninth voltage that is lower than the eighth voltage during the seventh period, and wherein the sixth voltage and the seventh voltage are lower than the eighth voltage.

7. The method of claim 6, wherein a reset discharge is generated in the first group light emitting cells during the seventh period.

8. The method of claim 1, wherein a scan pulse of a sixth voltage is applied to the first electrodes to be selected and a seventh voltage that is higher than the sixth voltage is applied to the first electrodes that are not selected from the first electrodes of the first group during the second period, and a difference between the seventh voltage and the sixth voltage is substantially the same as the first voltage.

9. The method of claim 8, wherein a difference between the second voltage and the fourth voltage is substantially the same as a difference between the seventh voltage and the sixth voltage.

10. The method of claim 1, wherein the second group cells are not initialized in the first period.

11. The method of claim 1, wherein the first, second, and third periods correspond to a first subfield of the first group, the fourth, fifth, and sixth periods correspond to a first subfield of the second group, and the first subfields of the first and second groups respectively have lowest weight values.

12. The method of claim 11, wherein the first group light emitting cells are sustain-discharged during the third period, and the second group light emitting cells are sustain-discharged during the sixth period.

13. The method of claim 1, further comprising, in a second subfield having a weight value that is lower than that of a first subfield of the first group and a first subfield of the second group:

initializing all discharge cells corresponding to the plurality of first electrodes; and sustain-discharging light emitting cells to be emitted, after selecting the light emitting cells from all the cells, wherein the first, second, and third periods correspond to the first subfield of the first group, and the fourth, fifth, and sixth periods correspond to the first subfield of the second group.

14. A plasma display comprising:

a plasma display panel comprising a plurality of first electrodes extending in a first direction and a plurality of second electrodes extending in a second direction crossing the first direction, the plurality of first electrodes comprising a plurality of groups having a first group and a second group, and a plurality of cells for displaying an image, the plurality of cells comprising first group cells and second group cells; and a driver for driving the plasma display panel, such that one frame is divided into a plurality of subfields, wherein the driver is adapted to initialize the first group cells corresponding to the first electrodes of the first group during a first period of a first subfield, to select first group light emitting cells from the first group cells during a second period of the first subfield, to sustain-discharge the first group light emitting cells selected during the second period of the first subfield during a third period of the first subfield, to initialize the second group cells corresponding to the first electrodes of the second group during a fourth period of the first subfield, to select second group light emitting cells from the second group cells during a fifth period of the first subfield, and to sustain-discharge the second group light emitting cells selected during the fifth period of the first subfield during a sixth period of the first subfield, wherein the driver is adapted to apply a first waveform gradually increasing from a first voltage to a second voltage and gradually decreasing to a third voltage to the first electrodes of the second group and to apply a second waveform gradually increasing to a fourth voltage and gradually decreasing to a fifth voltage to the first electrodes of the first group during the fourth period of the first subfield, and wherein the second voltage is higher than the fourth voltage, and the first group cells are not initialized during the fourth period of the first subfield.

15. A plasma display comprising:

a plasma display panel (PDP) comprising a plurality of scan electrodes comprising a plurality of groups having a first group and a second group; and a driver comprising a first group selection circuit and a second group selection circuit that are respectively coupled to the scan electrodes of the first group and the scan electrode of the second group, and for driving the PDP, wherein the first group selection circuit and the second group selection circuit respectively comprise a first transistor and a second transistor each having a node that is coupled to the respective plurality of scan electrodes, wherein the driver further comprises a capacitor having a first terminal coupled to the first transistor of the first group selection circuit and the first transistor of the second group selection circuit and a second terminal coupled to the first second transistor of the first group selection circuit and the second transistor of the second group selection circuit and is charged with a first voltage corresponding to a difference between a scan voltage and a non-scan voltage that are applied to the scan electrodes during an address period, and a third transistor coupled between a first power source for supplying a second voltage and the second terminal of the capacitor, wherein a first reset waveform is applied to the scan electrodes of the first group through the first power source, the third transistor, the capacitor, and the first transistor of the first group selection circuit during a first reset period, and wherein a second reset waveform is applied to the scan electrodes of the second group through the first power source, the third transistor, and the second transistor of the second group selection circuit during the first reset period.

16. The plasma display of claim 15, wherein a voltage at the scan electrodes of the first group is gradually increased to a voltage corresponding to a sum of the first voltage and the second voltage, and a voltage at the scan electrodes of the second group is gradually increased to the second voltage during the first reset period.

17. The plasma display of claim 15, wherein the driver further comprises a fourth transistor coupled between a second power source for supplying a third voltage that is lower than the second voltage and the second terminal of the capacitor, a third reset waveform is applied to the scan electrode of the first group through the second power source, the fourth transistor, the capacitor, and the first transistor of the first group selection circuit during a second reset period, and a fourth reset waveform is applied to the scan electrode of the second group through the second power source, the fourth transistor, and the second transistor of the second group selection circuit during the second reset period.

18. The plasma display of claim 17, wherein during the second reset period, a voltage at the scan electrodes of the first group is gradually increased to a voltage corresponding to a sum of the third voltage and the first voltage, and a voltage at the scan electrodes of the second group is gradually increased to the third voltage.

* * * * *

UNITED STATES PATENT AND TRADEMARK OFFICE

CERTIFICATE OF CORRECTION

PATENT NO. : 8,111,211 B2
APPLICATION NO. : 12/023927
DATED : February 7, 2012
INVENTOR(S) : Joo-Yul Lee It is certified that error appears in the above-identified patent and that said Letters Patent is hereby corrected as shown below:

In the Claims

Column 30, line 9 Before "second" Delete "first"

Signed and Sealed this
Ninth Day of April, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,111,211 B2
APPLICATION NO. : 12/023927
DATED : February 7, 2012
INVENTOR(S) : Joo-Yul Lee It is certified that error appears in the above-identified patent and that said Letters Patent is hereby corrected as shown below:

In the Claims

Column 30, Claim 15, line 9 Before "second" Delete "first"

This certificate supersedes the Certificate of Correction issued April 9, 2013.

Signed and Sealed this
Fifteenth Day of July, 2014

Michelle K. Lee

Michelle K. Lee
*Deputy Director of the United States Patent and Trademark Office*